US011786003B2

(12) United States Patent
Hatfield et al.

(10) Patent No.: US 11,786,003 B2
(45) Date of Patent: Oct. 17, 2023

(54) FOOTWEAR UPPER WITH MAGNETIC HOLD OPEN FOR FOOT ENTRY

(71) Applicant: NIKE, Inc., Beaverton, OR (US)

(72) Inventors: Tobie D. Hatfield, Lake Oswego, OR (US); Koosha Aslani, Tigard, OR (US); Jeffrey C. Spanks, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/965,855

(22) Filed: Oct. 14, 2022

(65) Prior Publication Data

US 2023/0029743 A1 Feb. 2, 2023

Related U.S. Application Data

(63) Continuation of application No. 16/904,791, filed on Jun. 18, 2020, now Pat. No. 11,490,690.
(Continued)

(51) Int. Cl.

| | |
|---|---|
| ***A43B 3/06*** | (2006.01) |
| ***A43B 1/00*** | (2006.01) |
| ***A43B 11/00*** | (2006.01) |
| ***A43B 23/02*** | (2006.01) |
| ***A43C 11/14*** | (2006.01) |
| ***A43B 3/24*** | (2006.01) |

(52) U.S. Cl.
CPC ..... *A43B 3/06* (2013.01); *A43B 1/0054* (2013.01); *A43B 3/242* (2013.01); *A43B 11/00* (2013.01); *A43B 23/0205* (2013.01); *A43B 23/0245* (2013.01); *A43C 11/1493* (2013.01)

(58) Field of Classification Search
CPC ..... A43B 1/0054; A43B 3/06; A43B 3/16; A43B 3/242; A43B 3/248; A43B 11/00; A43C 1/006
See application file for complete search history.

(56) References Cited

U.S. PATENT DOCUMENTS 470,316 A * 3/1892 Brown ..... A43C 1/006 36/105
2,420,239 A * 5/1947 Hack ..... A43C 1/006 36/105

(Continued)

FOREIGN PATENT DOCUMENTS

DE 102015017003 A1 * 7/2016
FR 3046915 A1 * 7/2017

(Continued)

*Primary Examiner* — Megan E Lynch
(74) *Attorney, Agent, or Firm* — Quinn IP Law

(57) ABSTRACT

An article of footwear may include a sole structure and an upper. The upper may include a first section and a second section and may define a foot-receiving cavity over the sole structure. The first section may be fixed to the sole structure, and the second section may articulate relative to the first section between an access position and a use position, the foot-receiving cavity being more exposed when the second section is in the access position. A magnetic coupling includes a first coupling member that may be operatively secured to the second section of the upper and a second coupling member may be operatively secured to the sole structure and positioned so that the first coupling member couples with the second coupling member by magnetic force when the second section is in the access position.

20 Claims, 17 Drawing Sheets

Related U.S. Application Data

(60) Provisional application No. 62/878,862, filed on Jul. 26, 2019.

(56) References Cited

U.S. PATENT DOCUMENTS 2,883,771 A * 4/1959 Sanchez ..... A43C 11/12 36/50.1
2,994,972 A 8/1961 Blair
4,392,311 A * 7/1983 Rudolf ..... A43B 3/16 36/50.1
4,489,509 A * 12/1984 Libit ..... A43B 3/18 36/7.1 R
5,319,869 A * 6/1994 McDonald ..... A43B 5/00 36/114
5,878,512 A * 3/1999 Cooper ..... A43B 3/16 36/107
5,926,978 A * 7/1999 Smith ..... A43B 11/00 36/138
5,943,793 A * 8/1999 Clements ..... A43C 5/00 36/89
6,938,361 B2 * 9/2005 Su ..... A43B 11/00 36/97
9,144,262 B2 * 9/2015 Ardell ..... A43B 23/0295
9,949,533 B2 * 4/2018 Feinstein ..... A43B 23/0205
2009/0217552 A1 9/2009 Paintin et al.
2010/0319216 A1 * 12/2010 Grenzke ..... A43C 11/165 36/50.1
2011/0146106 A1 * 6/2011 Kaufman ..... A43C 11/00 36/43
2012/0079746 A1 * 4/2012 Ferreira ..... A43B 1/0081 36/105
2014/0196317 A1 * 7/2014 Katz ..... A43B 23/07 36/89
2015/0216252 A1 * 8/2015 Wiens ..... A43B 1/0054 36/105
2015/0374065 A1 * 12/2015 DiFrancisco ..... A43B 3/30 36/105
2017/0042290 A1 * 2/2017 Hatfield ..... A43B 3/02
2018/0110292 A1 * 4/2018 Beers ..... A43B 3/0063
2018/0199659 A1 * 7/2018 Lintaman ..... A43C 11/146
2018/0213882 A1 * 8/2018 Morse ..... A43B 23/0295
2018/0295942 A1 * 10/2018 Drake ..... A43C 11/004
2018/0325208 A1 11/2018 Delaney
2018/0338562 A1 * 11/2018 Hatfield ..... A43B 3/242
2018/0338566 A1 * 11/2018 Hatfield ..... A43B 23/0245
2018/0338583 A1 * 11/2018 Sullivan ..... A43B 23/0245
2020/0323308 A1 * 10/2020 Dubuisson ..... A43B 9/00

FOREIGN PATENT DOCUMENTS

JP 2004236860 A 8/2004
KR 20100014032 A 2/2010
KR 20100103909 A 9/2010
WO WO-2010048203 A1 * 4/2010 ..... A43B 11/00

* cited by examiner

FOOTWEAR UPPER WITH MAGNETIC HOLD OPEN FOR FOOT ENTRY

CROSS-REFERENCE TO RELATED APPLICATION

This application is a continuation of U.S. Nonprovisional application Ser. No. 16/904,791, filed Jun. 18, 2020, which claims the benefit of U.S. Provisional Application No. 62/878,862, filed Jul. 26, 2019, both of which are hereby incorporated by reference in their entirety.

TECHNICAL FIELD

The present teachings generally include footwear having an upper configured for easy foot insertion.

BACKGROUND

Footwear may include a sole structure configured to be located under a wearer's foot to space the foot away from the ground. A footwear upper attached to the sole structure receives the foot. The fit of the upper to the foot may be adjusted with a fastening system so that the upper is loose enough to receive the foot but can be tightened around the foot to secure the foot relative to the sole structure. For example, a closure system, such as a lacing system, may include laces that are tied once the foot is received within the upper. Traditionally, placing footwear on a foot often requires the use of one or both hands to stretch the ankle opening of an upper, and hold the rear portion during foot insertion. The fit of the upper is then adjusted following foot insertion, such as by tying laces.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
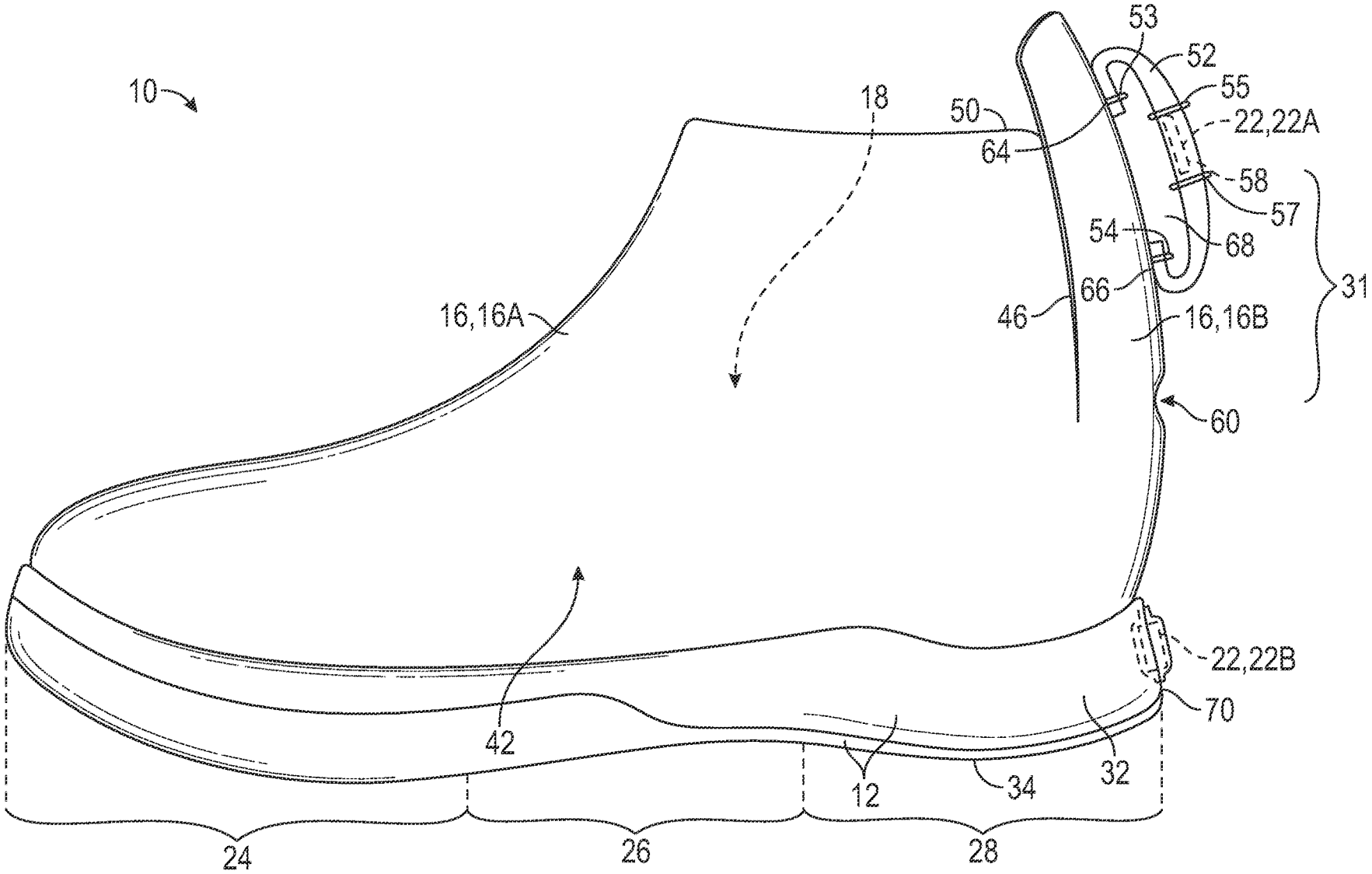
FIG. 1 is a lateral side view of an article of footwear with a rear section of the upper in a use position.

The present disclosure generally relates to an article of footwear. Various footwear embodiments are disclosed having features that enable foot insertion and securement quickly, with relative ease, and with less manual dexterity necessary than for footwear that requires manually stretching a throat area to enlarge a foot opening and/or that requires securement by tightening and tying a lace. More specifically, a magnetic coupling is used to hold open a section of the upper during foot insertion.

In an example, an article of footwear may include a sole structure and an upper. The upper may include a first section and a second section and defining a foot-receiving cavity over the sole structure. The first section may be fixed to the sole structure, and the second section may articulate relative to the first section between an access position and a use position, the foot-receiving cavity being more exposed when the second section is in the access position than when the second section is in the use position. The article of footwear includes a magnetic coupling with a first coupling member and a second coupling member, one of which is a magnet and the other of which comprises either of a magnet or a ferromagnetic material. The first coupling member may be operatively secured to the second section of the upper and the second coupling member may be operatively secured to the sole structure and positioned so that the first coupling member couples with the second coupling member when the second section is in the access position. The second section may be held in the access position by magnetic force between the first coupling member and the second coupling member, allowing easier foot entry into the more exposed foot-receiving cavity.

In one or more implementations, the first section may be a front section fixed to a forefoot region of the sole structure and the second section may be disposed at a heel region of the sole structure at least partially rearward of the first section. The second coupling member may be disposed at a rear extent of the sole structure in vertical alignment with the first coupling member.

In one or more implementations, the second section has a fold region at which the second section articulates to the access position. The first coupling member may be disposed above the fold region of the second section in the use position and below the fold region of the second section in the access position. In an aspect, the second section may be thinner at the fold region than above the fold region and than below the fold region, the second section defining a living hinge at the fold region.

In another aspect, a tab may extend from the second section. The first coupling member may be disposed on or in the tab. The tab may be attached to the second section at a first location and at a second location below the first location. The tab may extend from the first location to the second location (e.g., from the first location to the second location) without connection to the second section, the tab at least partially forming a loop. Stated differently, the tab may be spaced apart from and not connected to the second section everywhere between the first location and the second location. The first coupling member may be secured at a portion of the tab between the first location and the second location. Because the tab is looped, it can extend away from the second section when the first coupling member couples to the second coupling member, allowing the magnetic coupling to occur with less articulation of the second section than if the first coupling member were disposed directly on the second section, for example.

In still another aspect, the sole structure may include a recess in an exterior surface of the sole structure and the second coupling member may be at least partially disposed in the recess. A cover may extend over the second coupling member and may be secured to the sole structure.

In an example, the sole structure may include a midsole and an outsole. The midsole may have a rear wall at which the second coupling member is disposed. The outsole may have a bottom portion extending under the midsole and a rear portion that extends upward from the bottom portion onto the rear wall and over the second coupling member. In such an embodiment, the outsole is used both to serve as a traction member at the bottom portion, and to cover and secure the second coupling member at the rear portion. A separate cover is not necessary when the outsole is extended to perform both of these functions.

The above features and advantages and other features and advantages of the present teachings are readily apparent from the following detailed description of the modes for carrying out the present teachings when taken in connection with the accompanying drawings.

Referring to the drawings, wherein like reference numbers refer to like components throughout the views, various embodiments of footwear are disclosed having features that enable foot insertion and securement quickly, with relative ease, and with less manual dexterity than for footwear that requires manually stretching a throat area to enlarge a foot opening and/or that requires securement by tightening and tying a lace. More specifically, with reference to FIG. 1, an article of footwear 10 has a sole structure 12 and an upper 16 secured to the sole structure 12. The upper 16 forms a foot-receiving cavity 18 configured to receive a foot 20 (shown in phantom in FIG. 2 and moving in the direction of arrow A) without manually stretching the upper to enlarge an opening of the foot-receiving cavity 18. As discussed herein, a magnetic coupling 22 holds a rear section 16B of the upper 16 in an access position (shown in FIG. 2) to allow easy foot insertion. Additionally, insertion of the foot 20 may undo the magnetic coupling 22 in a hands-free manner, returning the rear section 16B to the use position (FIG. 1) to which it is biased.

The footwear 10 illustrated herein is depicted as an athletic shoe configured for sports such as basketball, but the footwear 10 is not limited to basketball shoes or other sports shoes. The footwear 10 may be a leisure shoe, a dress shoe, a work shoe, a sandal, a slipper, a boot, or any other category of footwear. As indicated in FIG. 1, the footwear 10 may be divided into a forefoot region 24, a midfoot region 26, a heel region 28, which are also the forefoot region, the midfoot region, and the heel region, respectively, of the sole structure 12 and the upper 16, and with an ankle region 31 defined by the upper 16. The forefoot region 24 generally includes portions of the article of footwear 10 corresponding with the toes and the joints connecting the metatarsals with the phalanges. The midfoot region 26 generally includes portions of the article of footwear 10 corresponding with the arch area and instep of the foot, and the heel region 28 corresponds with rear portions of the foot, including the calcaneus bone. The ankle region 31 corresponds with the ankle. The forefoot region 24, the midfoot region 26, the heel region 28, and the ankle region 31 are not intended to demarcate precise areas of the footwear 10, but are instead intended to represent general areas of the footwear 10 to aid in the following discussion.

The sole structure 12 includes a midsole 32 and an outsole 34. The midsole 32 may be formed from a compressible polymer foam element (e.g., a polyurethane or ethylvinylacetate foam) that attenuates ground reaction forces (i.e., provides cushioning) when compressed between the foot 20 and the ground during walking, running, or other ambulatory activities. The midsole 32 may incorporate fluid-filled chambers, plates, moderators, or other elements that further attenuate forces, enhance stability, or influence the motions of the foot 20. The midsole 32 may be a single, one-piece midsole, or could be multiple components integrated as a unit. In some embodiments, the midsole 32 may be integrated with the outsole 34 as a unisole. The outsole 34 may be one-piece, or may be several outsole components, and in one example may be formed from a wear-resistant rubber material that may be textured to impart traction and/or may include traction elements such as cleats secured to the midsole 32.

Figure 2:
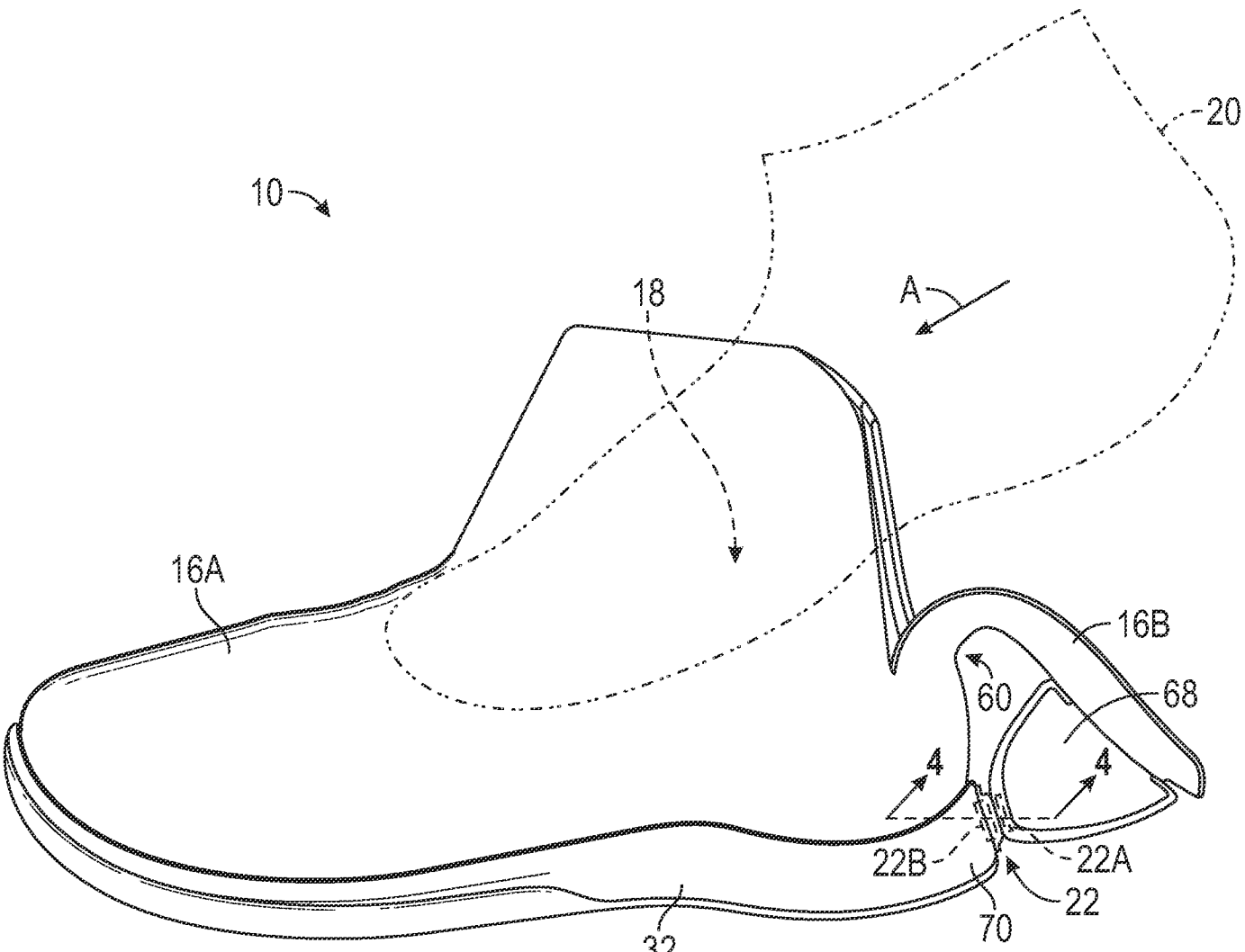
FIG. 2 is a lateral side view of the article of footwear of FIG. 1 with the rear section of the upper in an access position and a foot shown in phantom entering a foot-receiving cavity of the article of footwear.

The upper 16 includes a first section 16A, also referred to herein as a front section 16A, and a second section 16B, also referred to herein as a rear section 16B. In the embodiment of FIGS. 1-4, the sections 16A, 16B are configured to cooperate so that the rear section 16B is movable between a use position (FIG. 1) and an access position (FIG. 2). The movement between the positions may be accomplished in a hands-free manner or manually. For example, a wearer may use their hand to grip a looped tab 52 extending from the rear section 16B to articulate the rear section 16B to the access position. The wearer's entering foot 20 may brush against the inner side of the articulated rear section 16B, causing the rear section 16B to articulate back to the use position. Alternatively, the wearer may manually move the rear section 16B from one position to the other, or the wearer's other foot can be used to move the rear section 16B from the access position to the use position. The use position may be maintained solely via a bias of the rear section 16B to the use position as discussed herein and/or by securement of a strap, snaps, zippers, buttons or other fasteners (not shown). Although the second section (rear section 16B) is shown as being disposed in the heel region rearward of the first section (front section 16A), in other embodiments, the articulating second section could be disposed at the medial side or at the lateral side of the footwear, or could be disclosed at the front of the footwear assuming that the second coupling member is disposed at a corresponding location on or in the sole structure 12 so that when the second section articulates to the access position, the first coupling member couples to the second coupling member.

When the foot 20 is positioned within the foot-receiving cavity 18 of the footwear 10, it is supported on a foot-facing surface of the midsole 32. The foot-facing surface of the midsole 32 may be covered by a strobel (not shown) secured to a lower region of the upper 16. Also, an insole (not shown) may rest on the strobel or directly on the sole structure 12 in embodiments without a strobel, in which case the foot 20 is supported by both the sole structure 12 and the insole.

Figure 6:
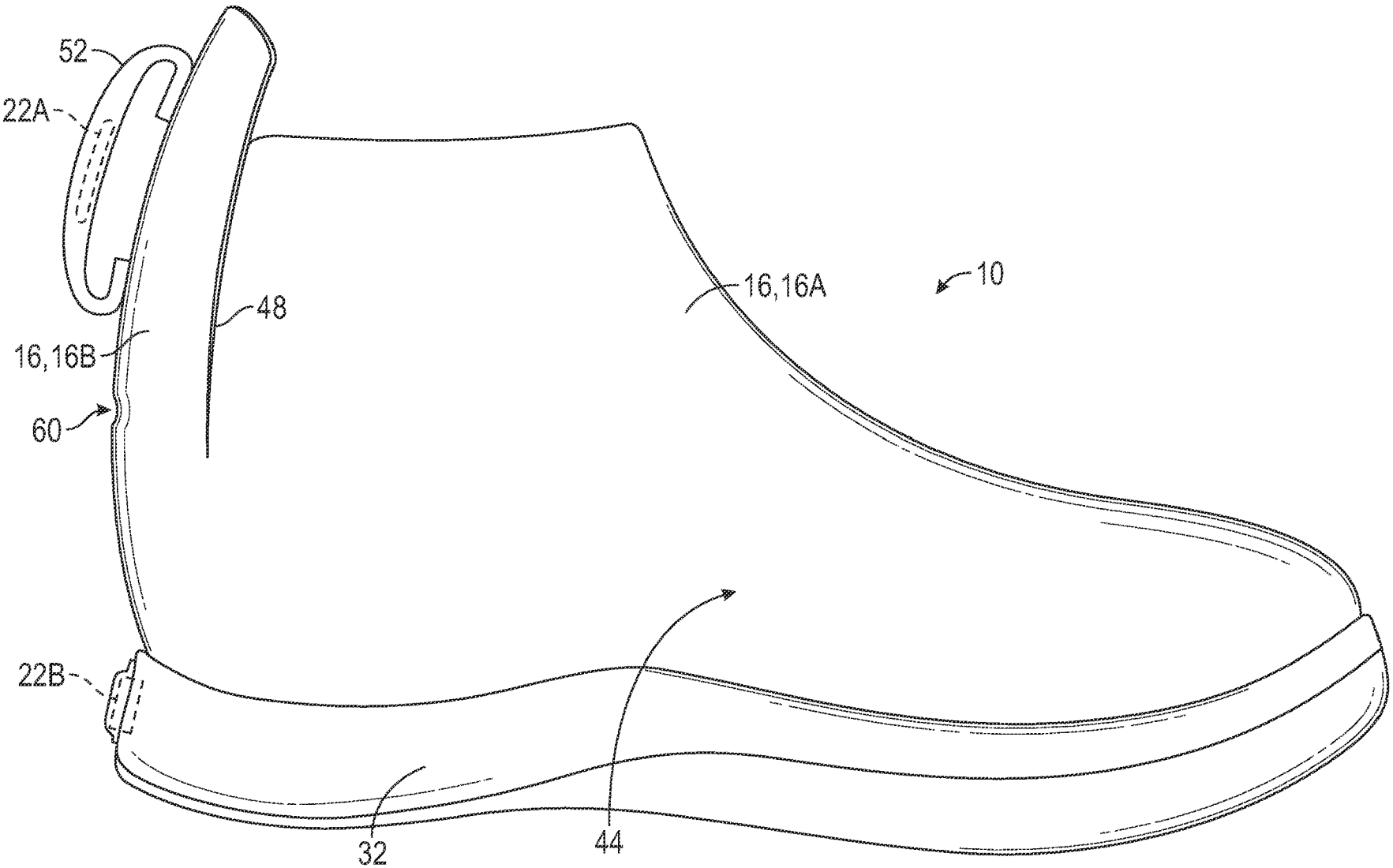
FIG. 6 is a medial side view of the article of footwear of FIG. 1 with the rear section of the upper in the access position.

The footwear 10 has a lateral side 42 (shown in FIG. 1) and a medial side 44 (shown in FIG. 6). The medial side 44 may be referred to as a first side, and the lateral side 42 may be referred to as a second side, or vice versa. The lateral side 42 and medial side 44 extend through each of the forefoot region 24, the midfoot region 26, the heel region 28, and the ankle region 31, and correspond with opposite sides of the article of footwear 10, each falling on an opposite side of a longitudinal midline of the article of footwear 10, as is understood by those skilled in the art. The medial side 44 is thus considered opposite to the lateral side 42.

The upper 16 may be a variety of materials, such as leather, textiles, polymers, cotton, foam, composites, etc. The front section 16A may include a material that has greater elasticity, greater breathability, or both greater elasticity and greater breathability than the material or materials of the rear section 16B to aid with foot insertion and comfort. The rear section 16B may include one or more materials that are stiffer than the front section 16A to provide stability in the heel region 28. For example, the front section 16A may be a polymeric material capable of providing elasticity, and may be of a braided construction, a knitted (e.g., warp-knitted) construction, or a woven construction.

The front section 16A and the rear section 16B are integral portions of the upper 16, with the rear section 16B defined as being bound by a lateral slit 46 in the upper 16 (FIG. 1) and a medial slit 48 in the upper 16 (FIG. 7), both slits 46, 48 bounding the rear section 16B and both extending downward from an upper extent 50 of the upper 16 partway to the sole structure 12.

The magnetic coupling 22 includes a first coupling member 22A and a second coupling member 22B. One of the coupling members 22A, 22B is a magnet and the other comprises either of a magnet or a ferromagnetic material so that the coupling members 22A, 22B couple to one another by magnetic force. In one nonlimiting example, the coupling member or members that are magnets may be permanent magnets, such as neodymium magnets with a grade or N rating of 38 Megagauss Oersted (MGOe) or more, such as from 38 to 52. Examples of ferromagnetic materials include but are not limited to iron, nickel, cobalt and alloys thereof. In the embodiments disclosed herein, both of the coupling members 22A, 22B are magnets. In another embodiment, the first coupling member 22A is a magnet, and the second coupling member 22B is a ferromagnetic material. In still another embodiment, the first coupling member 22A is a ferromagnetic material and the second coupling member 22B is a magnet. The first coupling member 22A is operatively secured to the rear section 16B of the upper 16 via a looped tab 52. The looped tab 52 spaces the first coupling member 22A outward and away from the rear section 16B which in turn allows the rear section 16B to be in a less articulated position in the access position than if the first coupling member 22A were directly secured to the rear surface of the rear section 16B. Accordingly, because less articulation is required, thicker or less flexible materials conducive to heel support may be used for the rear section 16B due to the positioning of the first coupling member 22A on the looped tab 52.

The rear section 16B is configured as a living hinge in order to allow the use of relatively thick materials in the rear section 16B while still allowing articulation. More specifically, the rear section 16B has a fold region 60 at which the rear section 16B articulates to the access position. As shown in FIG. 1, the rear section 16B is thinner at the fold region 60 than above the fold region 60 and than below the fold region 60 and therefore defines a living hinge at the fold region 60. For example, with reference to FIG. 7, padding 62 (indicated in hidden lines) may be disposed above the fold region 60 between an outer layer and an inner layer of the rear section 16B or internal or external to the remaining layers of the rear section 16B. Additionally padding 65 or stiffening heel counter may be disposed below the fold region 60, between the outer layer and the inner layer. The padding 62, 65 may be thicker than the fold region 60, which may be free from padding or may have thinner padding.

As is apparent in FIG. 1, the first coupling member 22A is disposed above the fold region 60 in the use position. As shown in FIG. 2, the first coupling member 22A is disposed below the fold region 60 of the rear section 16B in the access position. The looped tab 52 is flexible, and the magnetic force between the coupled coupling members 22A, 22B keeps the rear section 16B in the access position via the looped tab 52 which extends between the magnetic coupling 22 and the rear section 16B. The looped tab 52 is attached to the rear section 16B at a first location 64 above the first coupling member 22A with stitches 53 or otherwise, and at a second location 66 below the first coupling member 22A with stitches 54 of otherwise. The looped tab 52 extends between the first location 64 and the second location 66 without connection to the rear section 16B. Stated differently, the looped tab 52 is spaced apart from the rear section 16B between the first location 64 and the second location 66. The looped tab 52 extends vertically on the rear section 16B between the first location 64 and the second location 66. An opening 68 formed between the looped tab 52 and the rear section 16B extends horizontally (e.g., passes from one side of the looped tab 52 to the other side of the looped tab 52 in a horizontal direction).

In other embodiments, a tab that is not looped could be used in place of the looped tab 52. For example, the tab could be a straight strip anchored only at one end to the rear section 16B. However, looping the tab 52 by attaching it to the rear section at the first location 64 above the first coupling member 22A, and at the second location 66 below the first coupling member 22A provides forces on the looped tab 52 above and below the first coupling member 22A in FIG. 2, which may allow for more consistent and easier peeling of the coupling members 22A, 22B apart from one another (overcoming magnetic force) after foot insertion or by the action of the inserting foot 20. For example, the heel of the foot 20 may brush against the rear section 16B above the fold region 60 in FIG. 2, exerting an inward and downward force on the inner side of the rear section 16B, overcoming the magnetic force of the magnetic coupling 22 and causing the rear section 16B to articulate back to the use position. The rear section 16B may be biased to the use position shown by internal forces of the materials comprising the various layers of the rear section 16B being lower in the use position than when the rear section 16B is folded at the fold region 60. Accordingly, when the magnetic force of the magnetic coupling 22 is overcome, the bias urges the rear section 16B to articulate back to the use position.

The looped tab 52 may be a flexible, non-stretch material, such as a woven nylon. In the embodiment shown, the looped tab 52 is tubular, and the first coupling member 22A is disposed within the tubular looped tab 52 between the first location 64 and the second location 66. For example, ends of the tab 52 may be open to form the tube, but are secured to the rear section 16B and closed by the stitching 53, 54. For this reason, the tab 52 partially forms a loop exterior to the rear section 16B and is referred to as a looped tab. The rear section 16B forms the remainder of the loop. The first coupling member 22A is placed within the tube prior to securing the looped tab 52 to the rear section 16B. For example, stitching 55 extends through the tab 52 and the first coupling member 22A is placed in the tube of the tab 52 so that the top of the coupling member 22A is adjacent to the stitching 55 and then stitching 57 is sewn through the tube adjacent to the bottom of the first coupling member 22A to define a pocket 58 in the tab 52. The first coupling member 22A is thus disposed within the pocket 58 and is covered by the looped tab 52. In other embodiments, instead of being disposed in and covered by the looped tab 52 as in FIG. 1, the first coupling member 22A may be disposed on the looped tab 52, such as by adhering the first coupling member 22A to the exterior surface of the tab 52.

The second coupling member 22B is operatively secured to the sole structure 12 in the heel region 28. As shown, the second coupling member 22B is generally centered at a rear extent 70 of the sole structure 12 so that the first coupling member 22A aligns with the second coupling member 22B when the rear section 16B is in the access position. Stated differently, the second coupling member 22B is disposed at a rear extent 70 of the sole structure 12 in vertical alignment with the first coupling member 22A (as best shown in FIG. 6).

Figure 3:
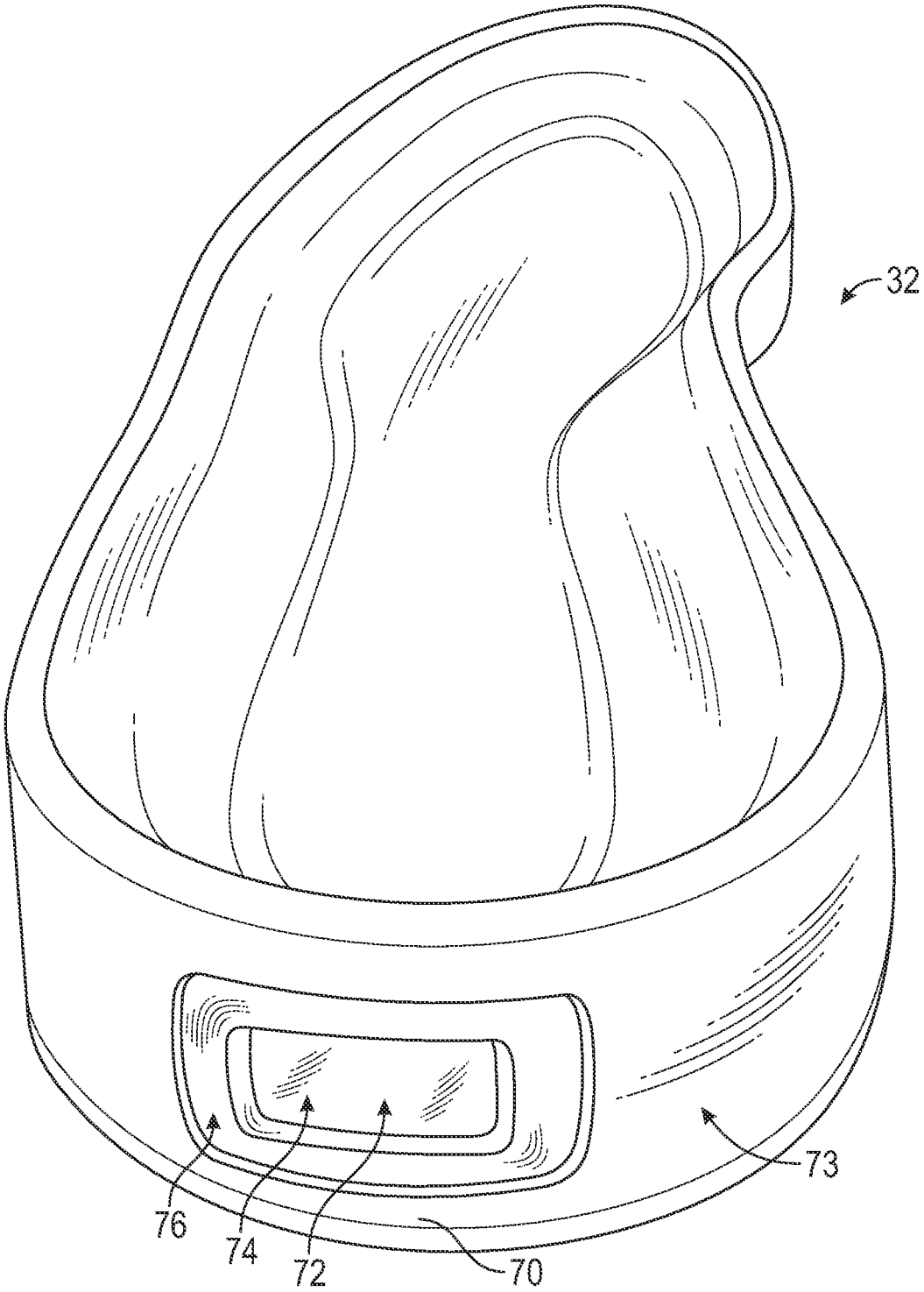
FIG. 3 is a rear perspective view of a sole structure of the article of footwear of FIG. 1.

Referring to FIG. 3, the midsole 32 of the sole structure 12 includes a recess 72 in an exterior surface 73 of the midsole 32. For example, the midsole 32 may be a molded polymeric foam formed with the recess 72. The recess 72 has a central portion 74 and a peripheral portion 76 surrounding the central portion 74. The central portion 74 extends further into the midsole 32 than the peripheral portion 76. In other words, the central portion 74 is deeper than the peripheral portion 76. The second coupling member 22B extends into the central portion 74. The second coupling member 22B may be thicker than the depth of the central portion 74 so that a portion of the second coupling member 22B may extend out of the central portion 74 further than the exterior surface 73. The second coupling member 22B is thus at least partially disposed in the recess 72. The second coupling member 22B may be adhered to the sole structure 12 in the recess 72 or may simply be held in place by a cover 78 that extends over the second coupling member 22B and is secured to the sole structure 12. For example, the cover 78 may be a rubber or plastic component that is a flexible sheet or is molded to extend over the portion of the second coupling member 22B that extends out of the recess 72, and then fit to the exterior surface 73 in the peripheral portion 76. The cover 78 may be adhered or otherwise secured to the exterior surface 73 in the peripheral portion 76 to hold the second coupling member 22B in the recess 72.

Figure 5:
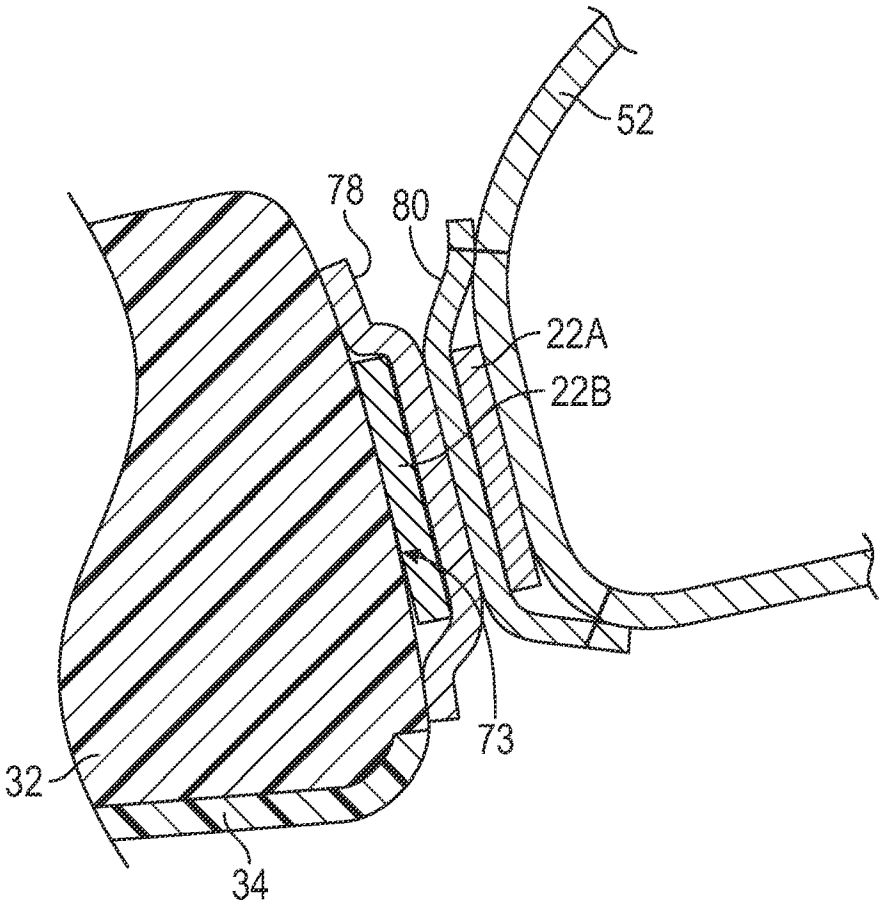
FIG. 5 is a fragmentary cross-sectional view of the article of footwear of FIG. 1 taken at a cross-section like that of FIG. 4 with an alternative arrangement of a magnet on the sole structure, in accordance with an alternative aspect of the present teachings.
Figure 4:
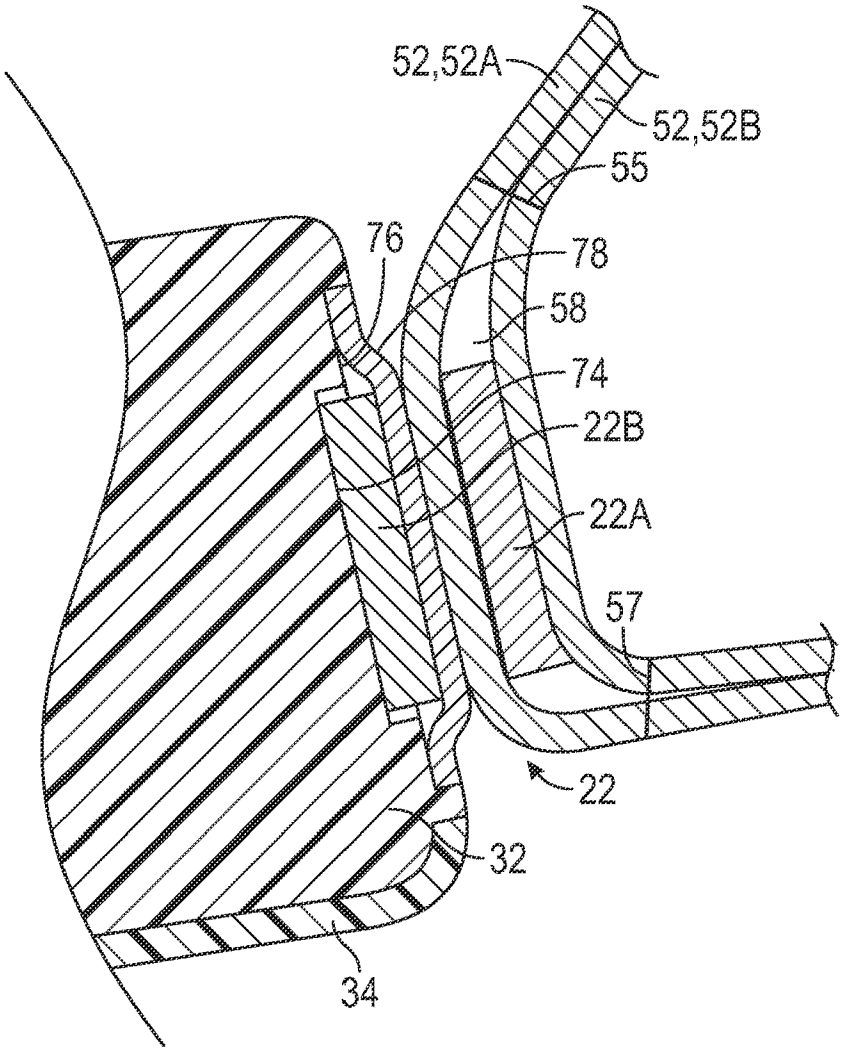
FIG. 4 is a fragmentary cross-sectional view of the article of footwear of FIG. 2 taken at lines 4-4 in FIG. 2.

FIG. 4 shows the first and second coupling members 22A, 22B coupled to one another. The tubular looped tab 52 has a front side 52A and a rear side 52B in cross-section. The magnetic force holds the coupling members 22A, 22B to one another through the cover 78 and through the front side 52A of the tubular looped tab 52. FIG. 5 shows an alternative embodiment in which the midsole 32 does not have a recess 72. Instead, the second coupling member 22B is disposed against the exterior surface 73 entirely outward of the midsole 32 and is covered by the cover 78. The second coupling member 22B may be adhered to the exterior surface 73 or may simply be held in position by the cover 78. In FIG. 5, the first coupling member 22A is adhered to the outer surface of the tab 52, which may not be tubular in the embodiment of FIG. 5. A cover 80 is sewn to the tab 52 to cover the first coupling member 22A.

FIG. 6 shows the medial side 44 of the footwear 10 with the rear section 16B in the use position. Snaps, zippers, buttons or other fasteners (not shown) may extend between the rear section 16B and the front section 16A at the slits 46, 48 to secure the rear section 16B in the use position. In another variation, a portion of the rear section 16B and the front section 16A may overlap at the slits 46, 48 and may be include hook-and-loop material to secure the rear section 16B in the use position.

Figure 7:
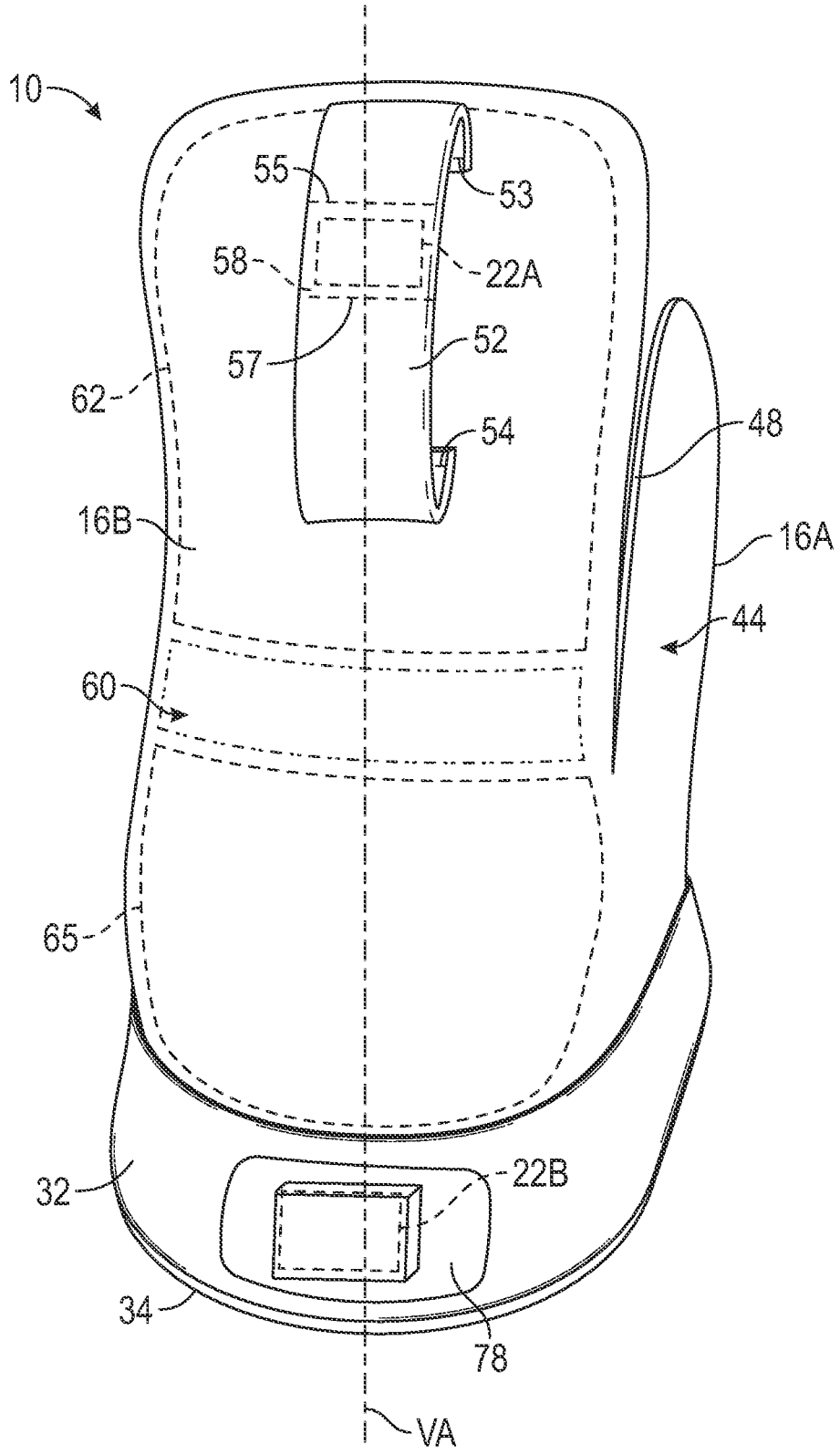
FIG. 7 is a rear perspective view of the article of footwear of FIG. 1 with the rear section in the use position.

FIG. 7 shows the rear of the article of footwear 10 with the fold region 60 horizontally-aligned with a lower extent of the slit 48 (as well as slit 46, not shown). It is apparent in FIG. 7 that the first coupling member 22A is vertically aligned with the second coupling member 22B in that they fall along a common vertical axis VA. The second coupling member 22B moves downward along a curved path of the articulating rear section 16B without moving laterally or with very little lateral movement so that, in the access position, the first coupling member 22A is outward of the second coupling member 22B and separated from the first coupling member 22A only by the cover 78 and the front side 52A of the tubular looped tab 52.

Figure 8:
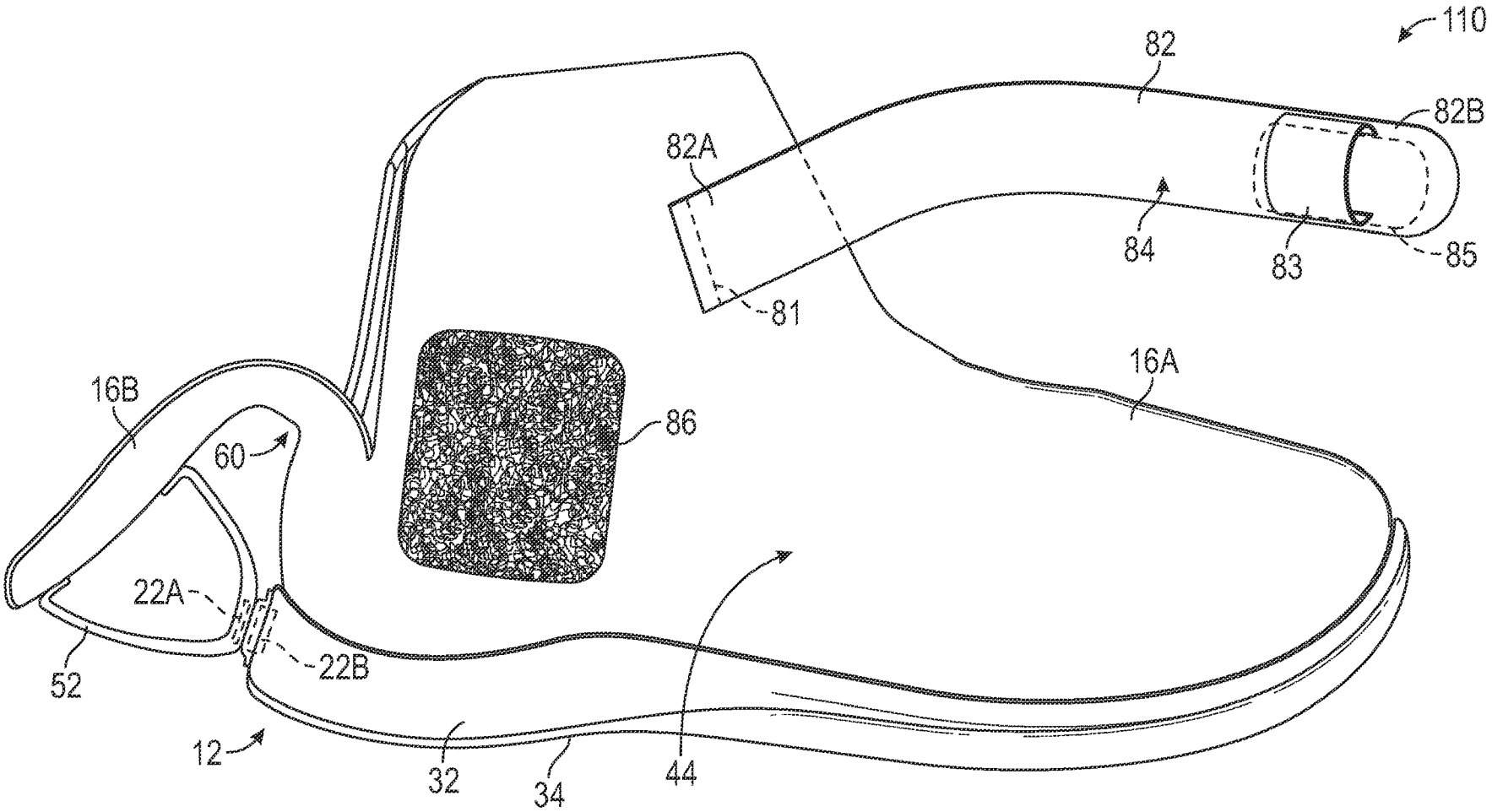
FIG. 8 is a medial side view of an article of footwear with a rear section of the upper in the access position and a strap in an unsecured position, in accordance with an alternative aspect of the present teachings.

FIG. 8 shows an alternative embodiment of an article of footwear 110 in which a strap 82 is used to help secure the rear section 16B in the use position. Components that are the same as described with respect to the article of footwear 10 are indicated with like reference numbers. FIG. 8 is a medial side view of the article of footwear 110 with the rear section 16B of the upper 16 in the access position and the strap 82 in an unsecured position. The strap 82 has a looped handle 83 secured to an exterior surface 84 (the outer side) of the strap 82. In the embodiment shown, the looped handle 83 is secured to an exterior surface 84 of the strap 82. In other embodiments, the looped handle 83 may be secured to an inner surface (the inner side or the interior side) of the strap 82 and still extend outward of the exterior surface 84. For example, the ends of the looped handle 83 may extend from the outer side to the inner side over the top and bottom edges of the strap 82.

The strap 82 has a proximal portion 82A (also referred to as a proximal end) secured to the front section 16A at the medial side 44 such as with stitching 81. The strap 82 extends from the medial side 44 of the front section 16A around the lateral side 42 and the rear section 16B back to the medial side 44 and has a distal portion 82B (also referred to as a distal end) releasably securable to the front section 16A of the upper 16 also at the medial side 44 (e.g., at the same side from which it extends).

The looped handle 83 extends from an outer side of the strap 82 nearer the distal end 82B than the proximal end 82A and at least partially forms a loop. The looped handle 83 is secured to the outer side of the strap 82 (e.g., the exterior surface 84 of the strap 82) and may be gripped by the wearer to assist with easy moving of the strap 82. The looped handle 83 is attached to the strap 82 at a first location 64 and at a second location 66 spaced apart from the first location 64. The looped handle 83 may be attached to the strap 82 at the locations 64, 66 such as by stitching. The looped handle 83 extends along the width of the strap 82 between the first location 64 and the second location 66 (e.g., from the first location 64 to the second location 66) without connection to the strap 82 between the locations 64, 66 so that an opening 91 is formed between the handle 83 and the strap 82, the opening 91 extending along the length of the strap 82 (e.g., parallel to the length of the strap 82), the handle 83 at least partially forming a loop with the strap 82.

A fastener portion 85 (shown only with hidden lines) such as a hook-and-loop fastener may be secured at the inner side of the strap 82 opposite to the looped handle 83. When the rear section 16B is in the use position and the strap 82 is secured as in FIG. 9, the strap 82 extends across the lateral slit 46, the rear section 16B, and the medial slit 48. A fastener portion 86 to which the fastener portion 85 is configured to secure may be secured to the front section 16A at the medial side 44. After insertion of the foot 20 and return of the rear section 16B to the use position, the strap 82 is sufficiently long so that it may be wrapped around the rear section 16B from the lateral side 42 to the medial side 44, and the fastener portion 85 may secure to the fastener portion 86 as shown in FIG. 9 by a single pressing motion of the distal portion 82B toward the front section 16A, and may release from the medial side 44 of the front section 16A via a single peeling motion away from the upper 16.

Figure 9:
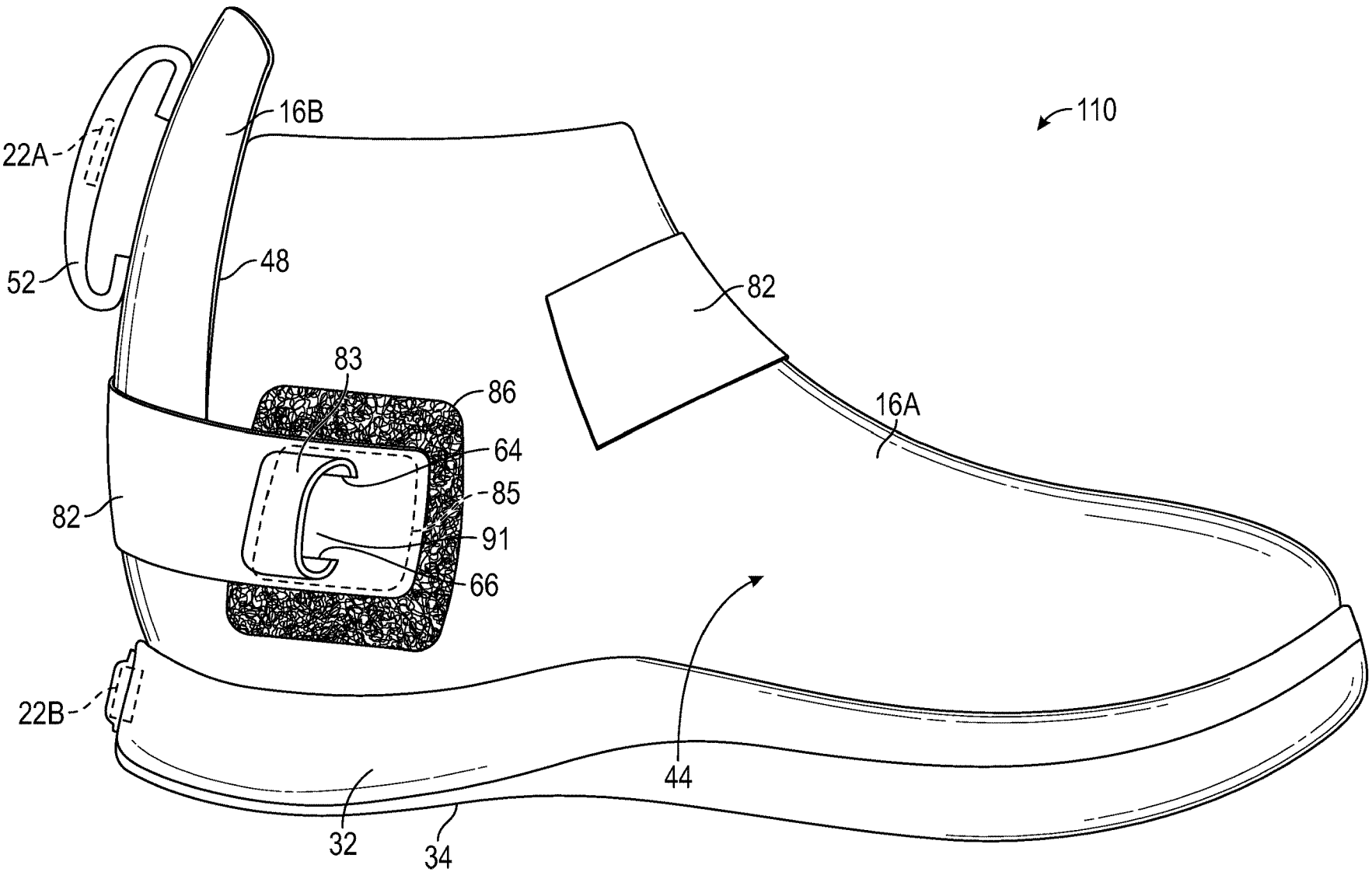
FIG. 9 is a medial side view of the article of footwear of FIG. 8 with the rear section of the upper in the use position and the strap in the secured position.

As shown in FIG. 9, the strap 82 is sized to be disposed against the rear section 16B of the upper 16 entirely below the first coupling member 22A when the rear section 16B is in the use position and the strap 82 is releasably secured to the upper 16. Alternatively, in another embodiment, the strap 82 could extend from the lateral side 42, wrap around the rear section 16B and secure to the lateral side 42. Still further, the proximal portion 82A of the strap 82 could be secured to the rear section 16B, and the strap 82 could wrap around from one of the lateral side and the medial side to the other of the lateral side and the medial side.

Figure 10:
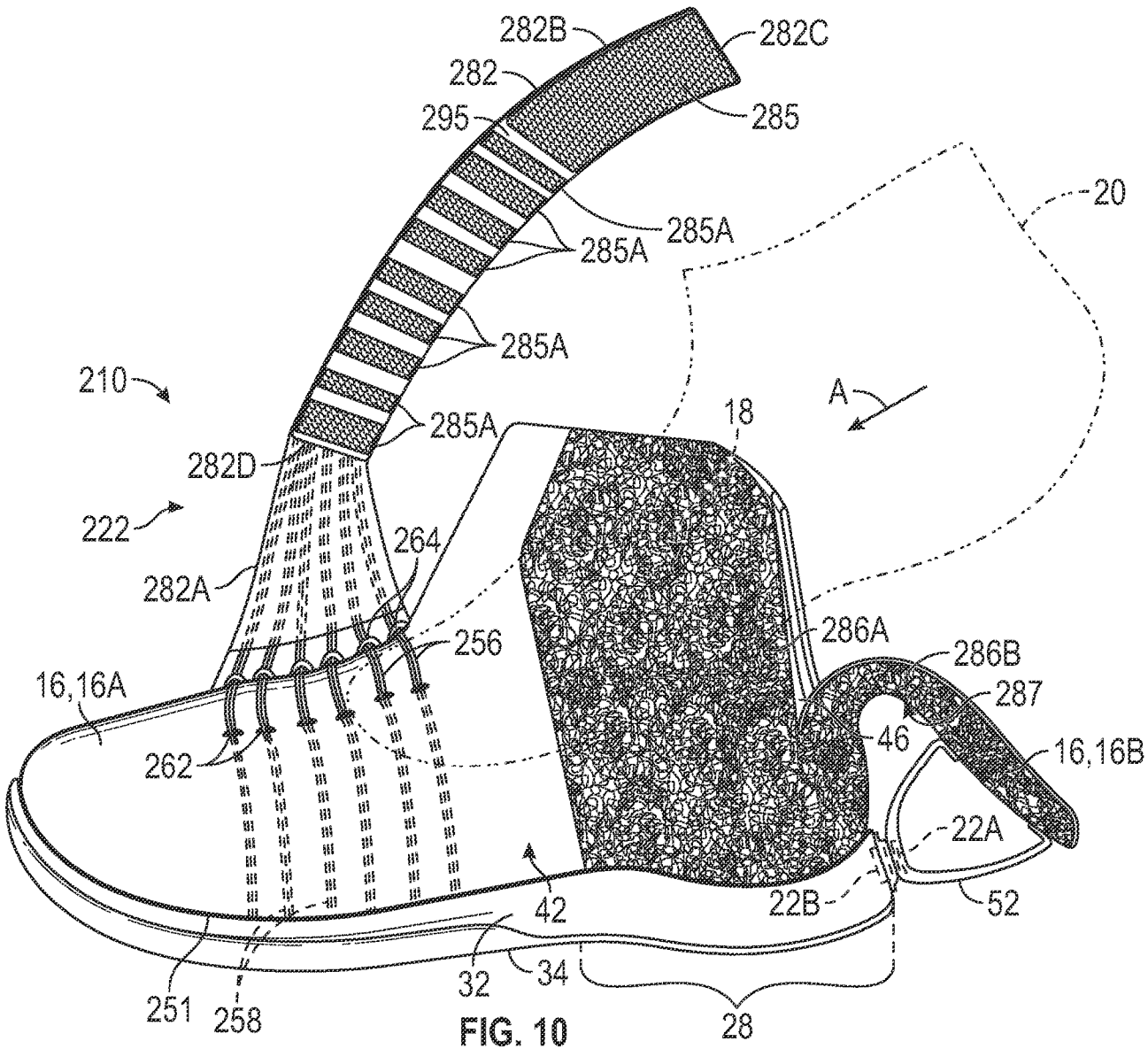
FIG. 10 is a lateral side view of an article of footwear with a rear section of the upper in the access position, a strap in an unsecured position, and a foot shown in phantom entering a foot-receiving cavity of the article of footwear, in accordance with an alternative aspect of the present teachings.
Figure 11:
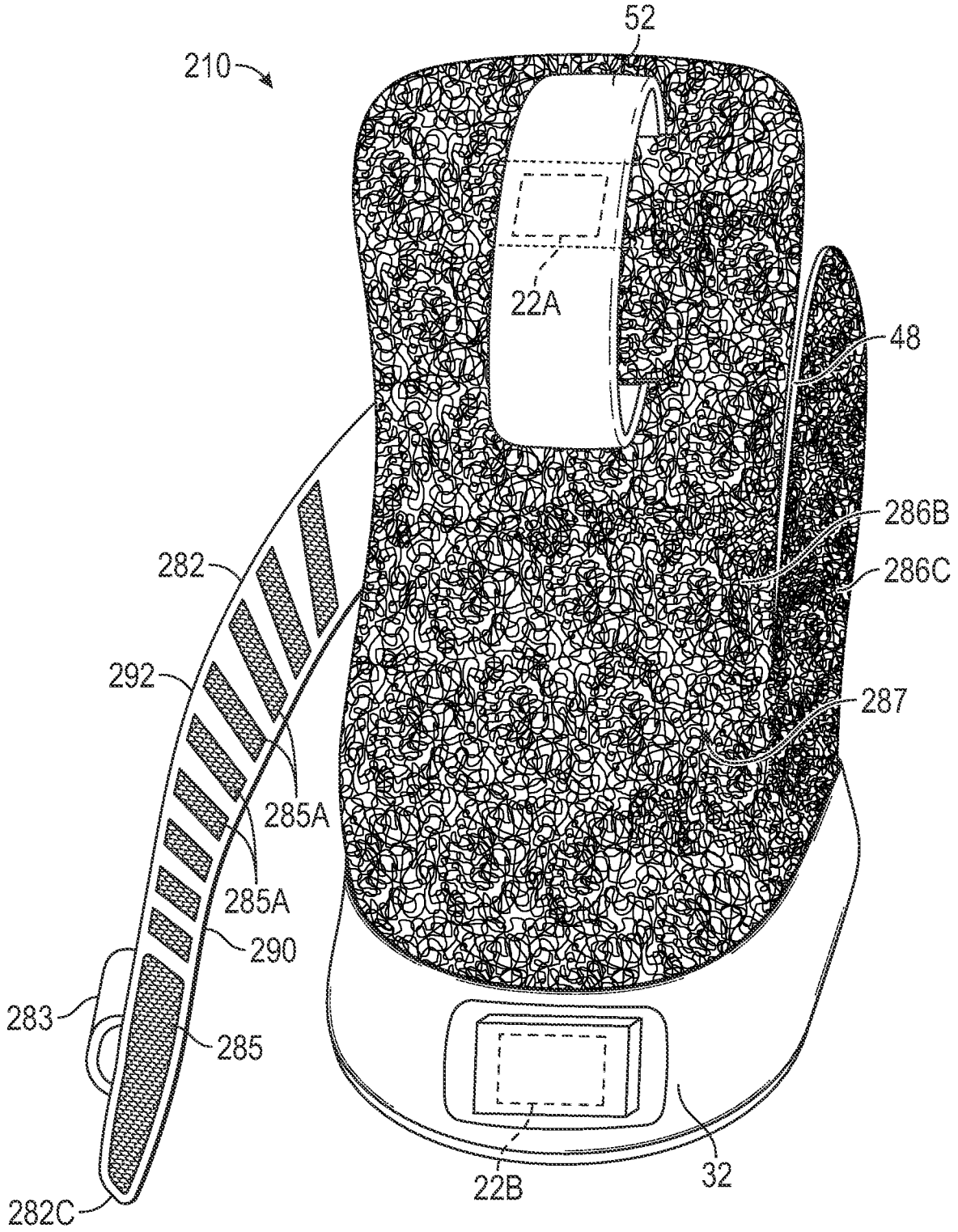
FIG. 11 is a rear perspective view of the article of footwear of FIG. 10 with the rear section in the use position and the strap in an unsecured position.
Figure 12:
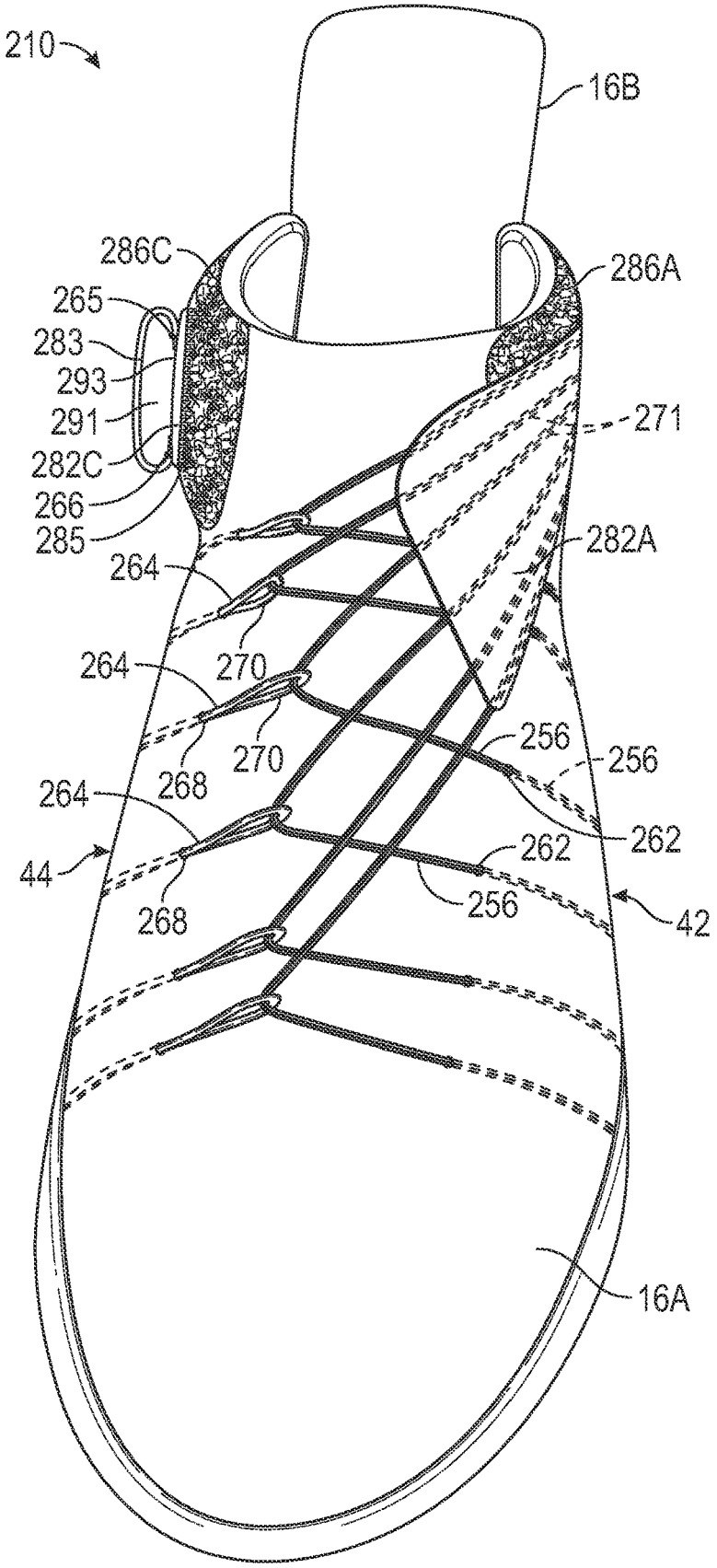
FIG. 12 is a front perspective view of the article of footwear of FIG. 10 with the rear section in the use position and the strap in a secured position.

FIGS. 10-12 show another embodiment of an article of footwear 210 with an alternative embodiment of a strap 282. Components that are the same as described with respect to the article of footwear 10 or 110 are indicated with like reference numbers. FIG. 10 is a lateral side view of the article of footwear 210 with the rear section 16B of the upper 16 in the access position, the strap 282 in an unsecured position, and a foot 20 shown in phantom entering a foot-receiving cavity 18 of the article of footwear 210.

The article of footwear 210 includes a fastening system 222 that includes the strap 282 as well as cables and fasteners, as discussed herein. The strap 282 has a distal portion 282B that is releasably securable to the medial side 44 of the front section 16A of the upper 16 via a fastener 285 by a single pressing motion of the distal portion 282B toward a fastener 286C (shown in FIG. 11 or 12) disposed on the front section 16A. The strap 282 releases from the medial side 44 of the front section 16A via a single peeling motion away from the upper 16. The distal portion 282B of the strap is further from the upper 16 than is a proximal portion 282A of the strap 282 when the strap 282 is held outward from the upper 16 as illustrated in FIG. 10.

The fastener 285 may be referred to as a first fastener or a first fastener portion, and the fastener 286C may be referred to as a second fastener or a second fastener portion. As shown in FIG. 12, the strap 282 is thus releasably securable to the front section 16A by fastener 285 nearer to a distal end 282C of the strap 282 than to the proximal end 282D of the strap 282. The looped handle 283 extends from an outer side 293 of the strap 282 nearer the distal end 282C than the proximal end 282D and at least partially forms a loop. The looped handle 283 is secured to the outer side 293 of the strap 282 (e.g., from the exterior surface of the strap 282) and may be gripped by the wearer to assist with easy moving of the strap 282. As best shown in FIG. 12, the looped handle 283 is attached to the strap 282 at a first location 265 and at a second location 266 spaced apart from the first location 265. The looped handle 283 may be attached to the strap 282 at the locations 265, 266 such as by stitching. The looped handle 283 extends along the width of the strap 282 between the first location 265 and the second location 266 (e.g., from the first location 265 to the second location 266) without connection to the strap 282 between the locations 255, 266 so that an opening 291 is formed between the handle 283 and the strap 282, the opening 291 extending along the length of the strap 282 (e.g., parallel to the length of the strap 282), the handle 283 at least partially forming a loop with the strap 282. The looped handle 283 is disposed opposite from the fastener 285, which is secured to an inner side 295 of the strap 282. Stated differently, the looped handle 283 is on the exterior side 293 of the strap 282 and the fastener 285 is on the inner side 295 of the strap 282 directly opposite from the looped handle 283.

The fastening system 222 provides an adjustable, secure fit to tighten the front section 16A around the foot 20 when the rear section 16B is in the access position, to thereby secure the foot 20 relative to the sole structure 12 underlying the upper 16. With reference to FIGS. 10 and 12, the fastening system 222 also includes a first plurality of tensioning cables 256. The tensioning cables 256 may have proximal ends 258 fixed to at least one of the front section 16A or the sole structure 12 on the lateral side 42 near the bite line 251. The strap 282 is non-releasably connected to the upper 16 only by the plurality of tensioning cables 256. The tensioning cables 256 are disposed either within the body of the front section 16A near the proximal ends 258, or are at least inward of an outer surface of the front section 16A until they emerge from the upper 16 at apertures 262 in the front section 16A where the tensioning cables 256 extend out of the front section 16A. For example, the tensioning cables 256 may be disposed between inner and outer layers of the front section 16A or may be disposed in channels integrally woven into or secured to the front section 16A. The securement of the proximal ends 258 and spacing of the apertures 262 ensures that portions of adjacent ones of the tensioning cables 256 between their proximal ends 258 and the apertures 262 do not overlap one another and are spaced apart from one another. Only some of the proximal ends 258, apertures 262, and tensioning cables 256 are indicated with reference numbers.

The fastening system 222 also includes a plurality of looped cables 264, best shown in FIG. 12 where only some of the looped cables 264 are indicated with reference numbers. The looped cables 264 have proximal ends that are fixed to at least one of the front section 16A of the upper 16 or the sole structure 12 on the medial side 44 near the bite line 251. The plurality of tensioning cables 256 extend upward along the lateral side 42 of the front section 16A from the proximal ends 258, and the plurality of looped cables 264 extend upward on the medial side 44 of the front section 16A from their proximal ends.

Similarly to the tensioning cables 256, the looped cables 264 are disposed within the front section 16A or are at least inward of an outer surface of the front section 16A until they emerge from the upper 16 at apertures 268 in the front section 16A where looped ends 270 of the looped cables 264 extend out of the front section 16A. The looped cables 264 may be disposed between inner and outer layers of the body of the front section 16A or may be disposed in channels integrally woven into or secured to the front section 16A. The securement of the proximal ends and spacing of the apertures 268 ensures that portions of adjacent ones of the looped cables 264 between the proximal ends and the apertures 268 do not overlap one another and are spaced apart from one another. The looped end 270 may be a continuous loop of the looped cable 264. Alternatively, the looped end 270 may be achieved by stitching or tying two portions of the cable 264 to one another to form a loop, or by any other means of forming an aperture at the end of the cable 264.

As used herein, a "cable", such as any of the tensioning cables 256 or the looped cables 264, is a flexible, elongated tensile element, and is a structure capable of withstanding a tensile load and includes, but is not limited to, a lace, a strand, a wire, a cord, a thread, or a string, among others. The cables 256, 264 may be located to (a) resist stretching of the upper 16 in specific directions or locations, (b) limit excess movement of the foot relative to the sole structure 12 and the upper 16, (c) ensure that the foot remains properly positioned relative to the sole structure 12 and the upper 16, and/or (d) reinforce locations where forces are concentrated. As non-limiting examples, suitable materials for the cables 256, 264 include various filaments, fibers, yarns, threads, or ropes that are formed from rayon, polyamide, polyester, polyacrylic, silk, cotton, carbon, glass, aramids (e.g., para-aramid fibers and meta-aramid fibers), ultra-high molecular weight polyethylene, liquid crystal polymer, copper, aluminum, or steel.

With continued reference to FIG. 12, the plurality of tensioning cables 256 extends through the plurality of looped cables 264 between the proximal ends 258 of the plurality of tensioning cables 256 and distal portions 271 of the cables 256 which are secured at the proximal portion 282A of the strap 282. Only some of the distal portions 271 are indicated with reference numbers. When the distal end 282B of the strap 282 is secured to the front section 16A as shown in FIG. 12, the plurality of tensioning cables 256 turn in direction at the plurality of looped cables 264, doubling back toward the lateral side 42 from which they originated.

As further discussed herein, fasteners are disposed on the strap 282 and on the upper 16 to provide a desirable combination of support at both the medial side 44 and the lateral side 42 of the front section 16A while still enabling adjustability in tightness and position of the strap 282. More specifically, fasteners 285, 285A are disposed on the strap 282 and fasteners 286A, 286B, 286C (also referred to as hook-and-loop material) are disposed on the upper 16 and cooperate to help releasably secure the strap 282 to the front section 16A and to the rear section 16B so that the strap 282 can maintain the rear section 16B in the use position. The fasteners 285, 285A are secured to the inner side of the strap 282 and may be referred to as a series of fastener portions. Fastener 286A is secured to the lateral side 42 of the front section 16A in the heel region 28 (see FIG. 10), fastener 286B is secured to an exterior surface 287 of the rear section 16B in the heel region 28 (see FIG. 11), and fastener 286C is secured to the medial side 44 of the front section 16A in the heel region 28 (see FIG. 11). The fasteners 285, 285A are configured to secure to the fasteners 286A, 286B, and 286C. In the embodiment shown, the fasteners 285, 285A, 286A, 286B, and 286C are hook-and-loop fasteners. The fasteners 285, 285A may be hooks, and the fasteners 286A, 286B, and 286C may be loops. Alternatively, the fasteners 285, 285A could be loops, and the fasteners 286A, 286B, and 286C could be hooks, some of the fasteners 285, 285A could be hooks and some could be loops, or some of the fasteners 286A, 286B, and 286C could be hooks and others could be loops, or one or more of the fasteners 285, 285A could be a combination of hooks and loops, and one or more of the fasteners 286A, 286B, and 286C could be a combination of hooks and loops. Still further, other types of fasteners could be used, such as snaps, buttons, etc.

As best shown in FIG. 10, the plurality of first fasteners 285 and 285A are spaced along the inner side 295 of the strap 282, which enables a greater variation in positioning of the strap 282 on the upper 16 in the secured state of the strap 282. Spacing multiple first fasteners 285A along the strap 282 may allow greater articulation of the strap 282 if the material of the strap 282 has greater flexibility than the material of the fasteners 285A. Accordingly, the strap 282 will more easily articulate at the spaces between the first fasteners 285A than if the fasteners 285A were not spaced apart from one another. Given that the first fasteners 285A are configured as strips arranged parallel with one another and will extend vertically between a bottom edge 290 of the strap 282 and a top edge 292 of the strap 282 when the strap 282 is releasably secured as shown in FIG. 12, the strap 282 is better able to articulate to extend across the rear of the rear section 16B from the lateral side 42 to the medial side 44.

The strap 282 crosses over the lateral slit 46 and the medial slit 48 when the rear section 16B is in the use position, and the strap 282 is secured at the medial side 44. The strap 282 may be manipulated in one motion to wrap around the rear of the upper 16 in this manner and releasably secure to the medial side 44 to maintain a desired amount of tension in the cables 256 and an associated fit of the upper 16 to the foot 20. Alternatively, the strap 282 may be first pulled to cause a desired degree of tension in the cables 256 and then, while maintaining the pull on the strap 282, may be initially releasably secured only to the fastener 286A at the lateral side 42 to maintain the tension in the cables 256 prior to then wrapping the strap 282 around the rear of the footwear 210 (e.g., across the lateral slit 46, the rear section 16B, and the medial slit 48). For example, the person manipulating the strap 282 may press the strap 382 against the fastener 286A, locking out the first portion of the strap 382 and the cables 256 connected thereto to create a desired amount of tension in the cables 256 and the associated fit of the front section 16A of the upper 16 against the foot 20. The remaining portion of the strap 382 (e.g., from the fastener 286A to the distal end 382C) may then be releasably secured to the medial side 44 of the front section 16A at the fastener 286C. Securing of the remaining portion of the strap 382 in this manner enables a different amount of tension than in the portion between the cable 256 and the fastener 286A. Alternatively, the remaining portion of the strap 382 may be left unsecured or may be doubled back to secure to the front section 16A without wrapping around the rear of the rear section 16B from the lateral side 42 to the medial side 44. In either of these alternative positions of the strap 382, the front section 16A will still remain tightened to the desired level due to the securement of the middle portion of the strap 382 at the fastener 286A. A wearer can thus gain a customized fit of the upper over the forefoot and around the ankle by first tightening the strap a desired amount and securing it to the fastener 286A (locking down the forefoot and midfoot fit), and then selecting a position and potentially different tightness of the remaining portion of the strap to enable a desired fit around the ankle. FIG. 12 shows where the strap 282 can interface with and attach to the fastener 286A so that it can be initially secured prior to wrapping around the rear section 16B and further securing to the fasteners 286B and 286C.

Figure 13:
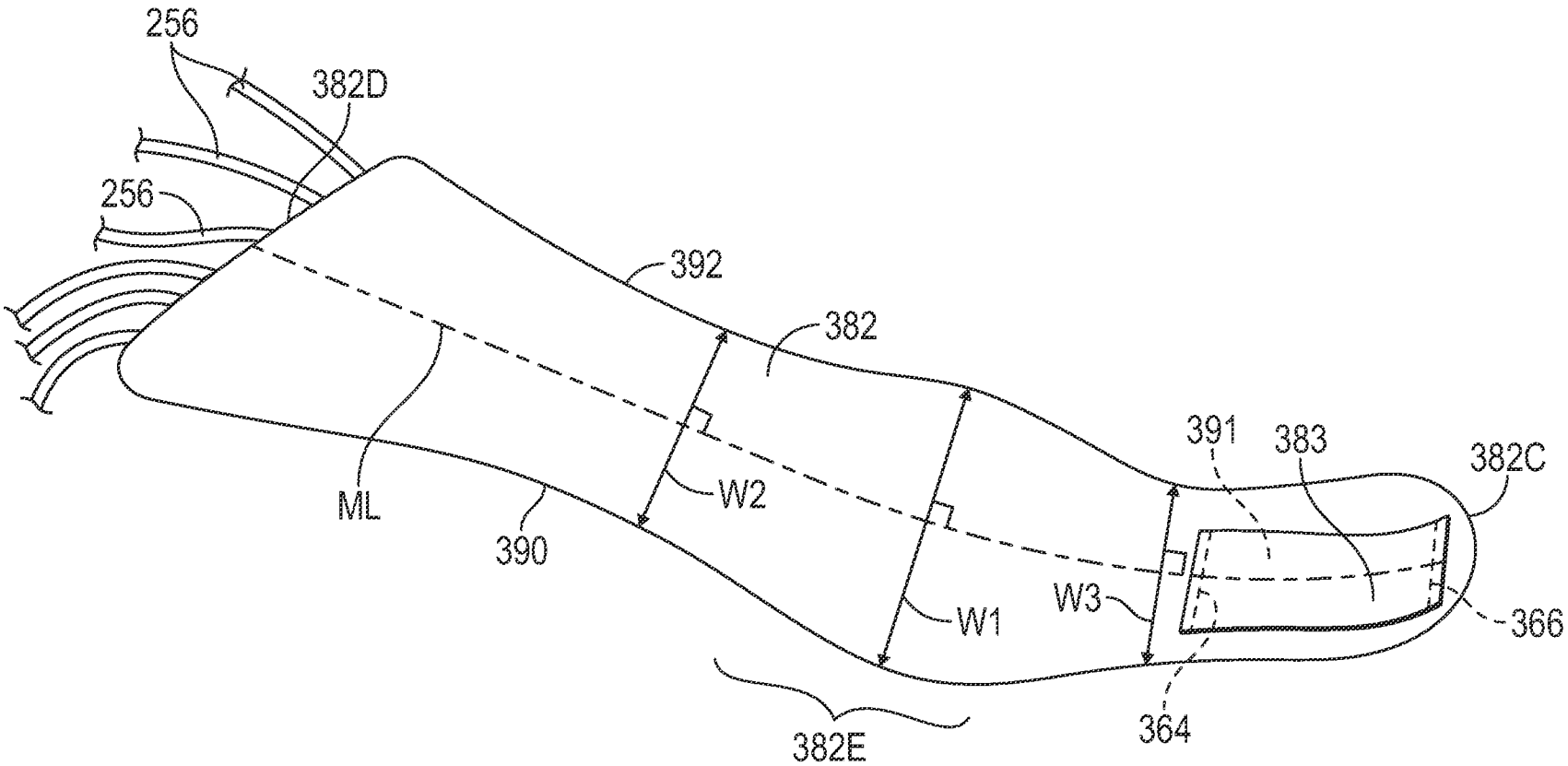
FIG. 13 is a plan view of an outer side of an alternative strap for the article of footwear of FIG. 10 showing attached tensioning cables in fragmentary view.
Figure 14:
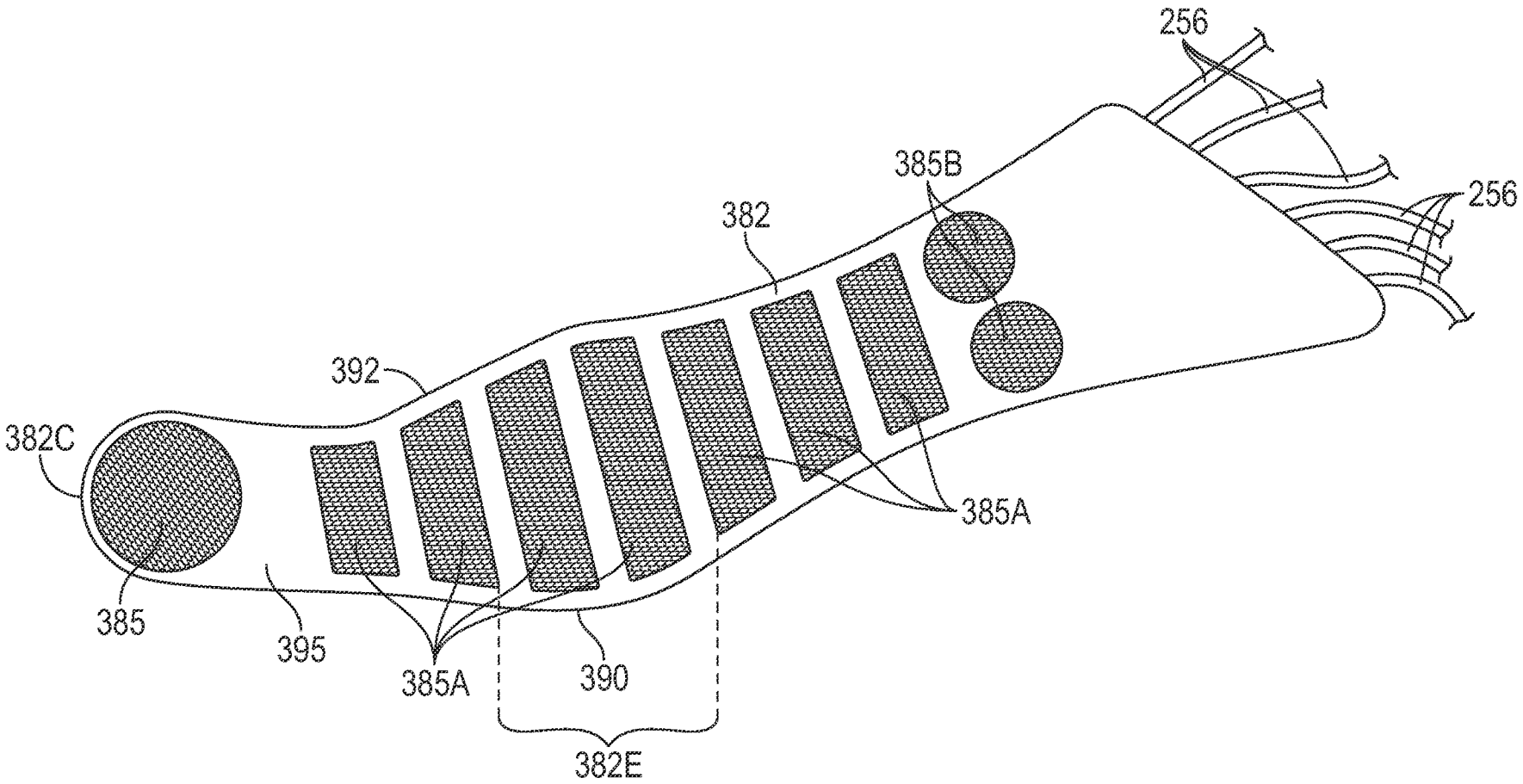
FIG. 14 is a plan view of an inner side of the alternative strap of FIG. 13 showing attached tensioning cables in fragmentary view.
Figure 15:
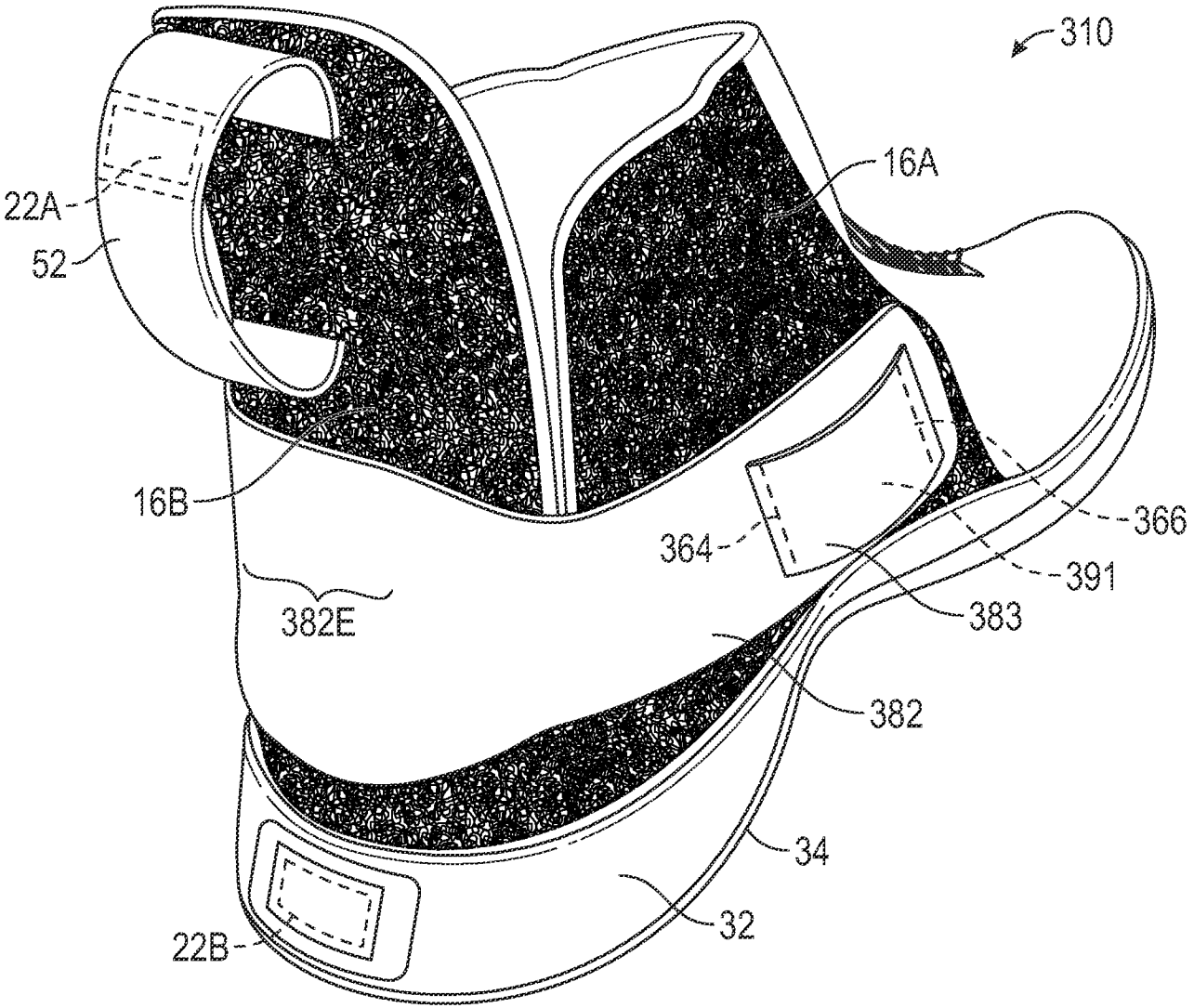
FIG. 15 is a perspective view showing the rear and medial side of an article of footwear with the alternative strap of FIGS. 13-14 in a secured position.

FIGS. 13 and 14 show an alternative strap 382 that can be used in place of strap 282 on an article of footwear 310 shown in FIG. 15. Components of the article of footwear 310 that are the same as those in article of footwear 10, 110 and/or 210 are indicated with like reference numbers. In FIGS. 13 and 14, the strap 282 is shown with the attached cables 256 in fragmentary view and the strap 382 laid flat. As can be seen in FIG. 13, a width of the strap 382 between an upper edge 392 of the strap and a lower edge 390 of the strap varies between the distal end 382C and the proximal end 382D. More specifically, the strap 382 is wider at an intermediate portion 382E of the strap (indicated at width W1) than at a portion (indicated at width W2) between the intermediate portion 382E and the proximal end 382D and also wider at the intermediate portion 382E than at a portion (indicated at width W3) between the intermediate portion 382E and the distal end 382C where all widths are measured perpendicular to a longitudinal midline ML of the strap 382.

Fasteners are disposed on the strap 382 and on the upper 16 to provide a desirable combination of support at both the medial side 44 and the lateral side 42 of the front section 16A, while still enabling adjustability in tightness and position of the strap 382. More specifically, fasteners include fasteners 385, 385A, and 385B on the strap 382 that cooperate with fasteners 286A, 286B, and 286C on the upper 16 to help releasably secure the strap 382 to the front section 16A and to the rear section 16B so that the strap 382 can maintain the rear section 16B in the use position. The fasteners 385, 385A, and 385B are secured to the inner side of the strap 382 and may be referred to as a series of fastener portions. The fasteners 385, 385A, and 385B may be hook-and-loop fasteners. The fasteners 385, 385A, and 385B may be hooks, and the fasteners 286A, 286B, and 286C may be loops. Alternatively, the fasteners 385, 385A, and 385B could be loops, and the fasteners 286A, 286B, and 286C could be hooks, some of the fasteners 385, 385A, and 385B could be hooks and some could be loops, while some of the fasteners 286A, 286B, and 286C could be hooks and others could be loops, or one or more of the fasteners 385, 385A, and 385B could be a combination of hooks and loops, and one or more of the fasteners 286A, 286B, and 286C could be a combination of hooks and loops. Still further, other types of fasteners could be used, such as snaps, buttons, etc.

As best shown in FIG. 14, the plurality of first fasteners 385, 385A, 385B are spaced along the inner side 395 of the strap 382, which enables a greater variation in positioning of the strap 382 on the upper 16 in the secured state of the strap 382. Spacing multiple first fasteners 385A along the strap 382 may allow greater articulation of the strap 382 if the material of the strap 382 has greater flexibility than the material of the fasteners 385A. Given that the first fasteners 385A are configured as strips arranged parallel with one another and will extend vertically between a bottom edge 390 of the strap 382 and a top edge 392 of the strap 382 when the strap 382 is releasably secured as shown in FIG. 15, the strap 382 is better able to articulate to extend around the rear of the rear section 16B from the lateral side 42 to the medial side 44. The fasteners 385B are rounded rather than strips, which may provide a larger locating area to help with an initial pressing against and securing of the strap 382 at the medial side 44 to maintain the tension in the cables 256. The fastener 385 is also circular but could be other shapes.

The strap 382, the cables 256 and the upper 16 are sized so that the widest portion of the strap 382 (e.g., the intermediate portion 382E) is disposed against and extends across the rear section 16B when the rear section 16B is in the use position and the strap 382 is releasably secured, as shown in FIG. 15, to provide increased lateral support and stability to the wearer's heel. The strap 382 fits entirely below the first coupling member 22A against the rear section 16B when secured to the front section 16A even though the widest portion (the intermediate portion 382E) is disposed at the rear section 16B. This variation in width causes the strap 382 to be convex along the upper edge 392 of the strap 382 at the intermediate portion 382E and convex along the lower edge 390 of the strap 382 at the intermediate portion 382E.

With reference to FIG. 13, unlike the looped handle 283 of the article of footwear 210, the looped handle 383 extends along the length (e.g., the longitudinal midline LM) of the strap 382 between a first location 364 and a second location 366 at which it is stitched or otherwise secured to the strap 382, and an opening 391 is formed by the looped handle 383 and the strap 382 between the first location 364 and the second location 366. The opening 391 extends perpendicular to the length of the strap 382. The looped handle 383 extends between the first location 364 and the second location 366 (e.g., from the first location 364 to the second location 366) without connection to the strap 382 between the locations 364, 366.

Figure 16:
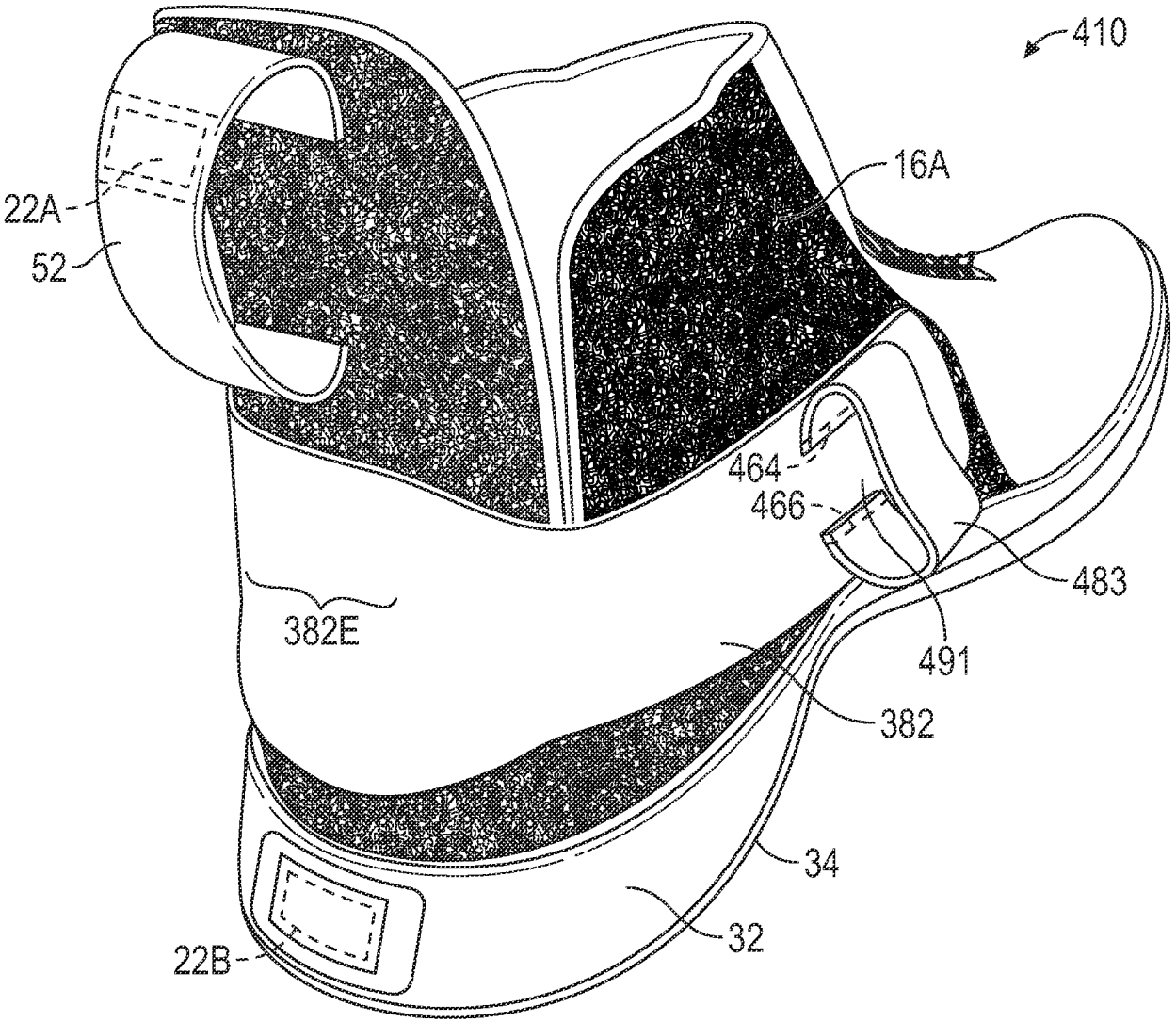
FIG. 16 is a perspective view showing the rear and medial side of the article of footwear of FIG. 15 with the alternative strap of FIGS. 13-14 in a secured position and with an alternative looped handle on the strap.

FIG. 16 shows another embodiment of an article of footwear 410 alike in all aspects to article of footwear 310 except that a looped handle 483 used in place of looped handle 383 is secured to the strap 382 with the first location 464 above the second location 466 so that an opening 491 between the looped handle 483 and the strap 382 extends along the length of the strap 382 (e.g., horizontally). The opening 491 extends parallel to the length of the strap 382. The looped handle 483 extends between the first location 464 and the second location 466 (e.g., from the first location 464 to the second location 466) without connection to the strap 382 between the locations 464, 466.

Figure 17:
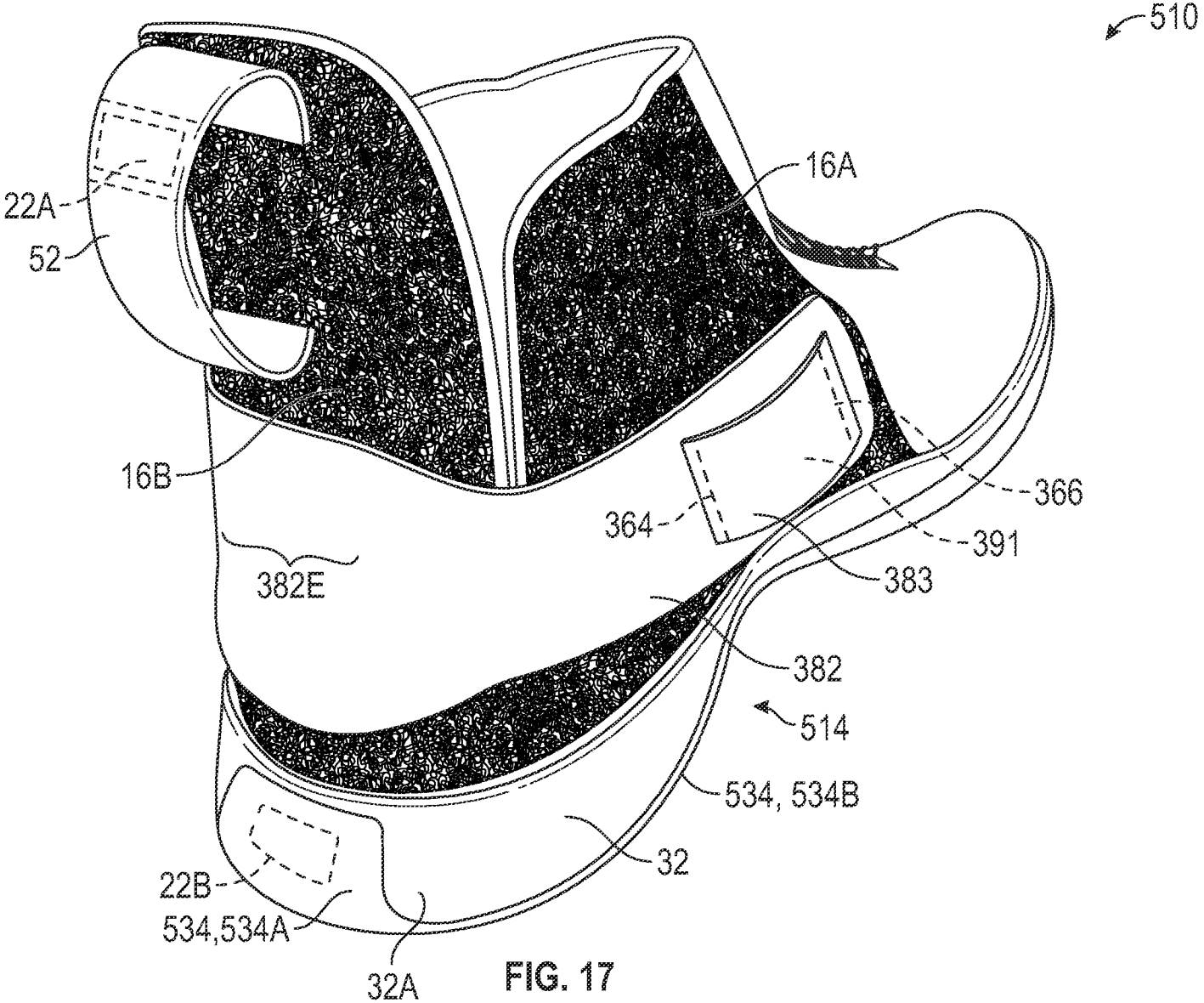
FIG. 17 is a perspective view showing the rear and medial side of an article of footwear with the alternative strap of FIGS. 13-14 in a secured position and with an outsole covering the second coupling member.

FIG. 17 is a perspective view showing the rear and medial side of an article of footwear 510 with the alternative strap 382 of FIGS. 13-14 in a secured position and with an outsole 534 covering the second coupling member 22B. More specifically, the article of footwear 510 has a sole structure 514 that includes a midsole 32 and an outsole 534. The midsole 32 may has a rear wall 32A at which the second coupling member 22B is disposed. The second coupling member 22B may be adhered to an exterior surface of the rear wall 32A. The rear wall 32A may have a recess similar to recess 72 of FIG. 3 that partially houses the second coupling member 22B. In another example, the rear wall 32A has no recess, and the second coupling member 22B simply interfaces with the rear wall 32A and so is disposed entirely outward of the midsole 32.

Figure 18:
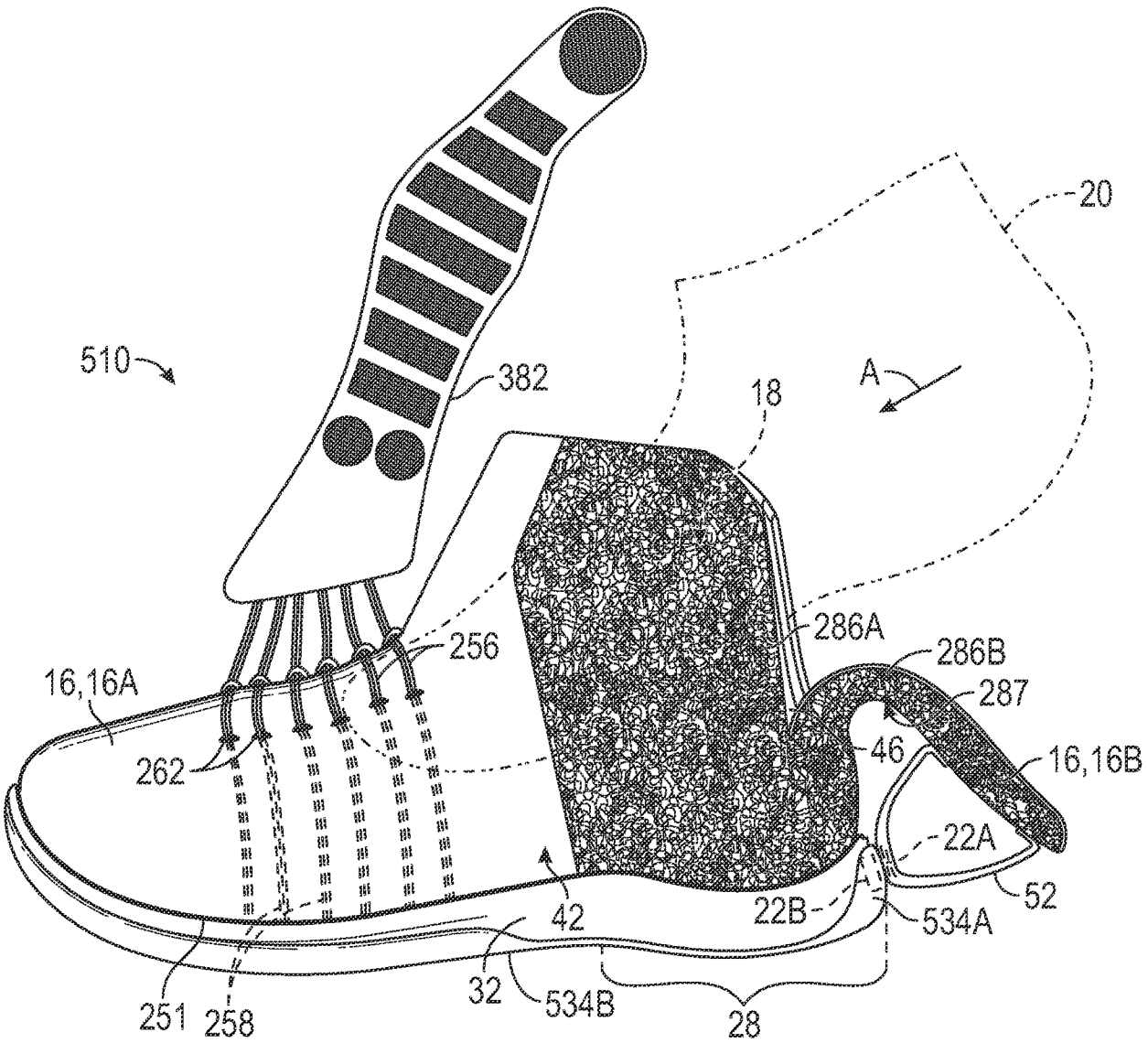
FIG. 18 is a lateral side view of the article of footwear of FIG. 17 with a rear section of the upper in the access position, the strap in an unsecured position, and a foot shown in phantom entering a foot-receiving cavity of the article of footwear.

The outsole 534 has a rear portion 534A and a bottom portion 534B that may be integral with the rear portion 534A as a one-piece component. The bottom portion 534B extends under the midsole 32 and the rear portion 534A extends upward from the bottom portion 534B onto the rear wall 32A and over the second coupling member 22B. In such an embodiment, the outsole 534 is used both to serve as a traction member at the bottom portion 534B, and to cover and secure the second coupling member 22B at the rear portion 534A. A separate cover for the second coupling member 22B is not necessary when the outsole 534 is extended to perform both of these functions. FIG. 18 is a lateral side view of the article of footwear 510 of FIG. 17 with a rear section 16B of the upper 16 in the access position, the strap 382 in an unsecured position, and a foot 20 shown in phantom entering a foot-receiving cavity 18 of the article of footwear 510.

The following Clauses provide example configurations of an article of footwear disclosed herein.

Clause 1: An article of footwear comprising: a sole structure; an upper including a first section and a second section and defining a foot-receiving cavity over the sole structure; wherein the first section is fixed to the sole structure, and the second section articulates relative to the first section between an access position and a use position, the foot-receiving cavity being more exposed when the second section is in the access position than when the second section is in the use position; and a magnetic coupling including a first coupling member and a second coupling member, one of which is a magnet and the other of which comprises either of a magnet or a ferromagnetic material; wherein the first coupling member is operatively secured to the second section of the upper and the second coupling member is operatively secured to the sole structure and positioned so that the first coupling member couples with the second coupling member when the second section is in the access position, the second section held in the access position by magnetic force between the first coupling member and the second coupling member.

Clause 2: The article of footwear of Clause 1, wherein: the second section has a fold region at which the second section articulates to the access position; and the first coupling member is disposed above the fold region of the second section in the use position and below the fold region of the second section in the access position.

Clause 3: The article of footwear of Clause 2, wherein the second section is thinner at the fold region than above the fold region and than below the fold region, the second section defining a living hinge at the fold region.

Clause 4: The article of footwear of any of Clauses 1-3, further comprising: a tab extending from the second section; wherein the first coupling member is disposed on or in the tab.

Clause 5: The article of footwear of Clause 4, wherein: the tab is attached to the second section at a first location and at a second location below the first location, and the tab extends between the first location and the second location without connection to the second section, the tab at least partially forming a loop; and the first coupling member is secured at a portion of the tab between the first location and the second location.

Clause 6: The article of footwear of Clause 5, wherein the tab extends vertically on the second section from the first location to the second location, and an opening formed between the tab and the second section extends horizontally.

Clause 7: The article of footwear of Clause 6, wherein the tab is a flexible, non-stretch material.

Clause 8: The article of footwear of Clause 5, wherein the first coupling member is covered by the tab.

Clause 9: The article of footwear of Clause 8, wherein the tab is tubular and the first coupling member is disposed within the tab.

Clause 10: The article of footwear of Clause 9, further comprising: stitching extending through the tab to define a pocket in the tab; and wherein the first coupling member is disposed within the pocket.

Clause 11: The article of footwear of any of Clauses 1-10, wherein: the first section is a front section fixed to a forefoot region of the sole structure; the second section is disposed at a heel region of the sole structure at least partially rearward of the first section; and the second coupling member is disposed at a rear extent of the sole structure in vertical alignment with the first coupling member.

Clause 12: The article of footwear of Clause 11, wherein an upper extent of the second section extends further above the sole structure than the first section when the second section is in the use position.

Clause 13: The article of footwear of any of Clauses 1-12, wherein the sole structure includes a recess in an exterior surface of the sole structure and the second coupling member is at least partially disposed in the recess.

Clause 14: The article of footwear of Clause 13, further comprising: a cover extending over the second coupling member and secured to the sole structure.

Clause 15: The article of footwear of any of Clauses 1-13, further comprising: a midsole having a rear wall at which the second coupling member is disposed; and an outsole having a bottom portion extending under the midsole, and having a rear portion that extends upward from the bottom portion onto the rear wall and over the second coupling member.

Clause 16: The article of footwear of any of Clauses 1-15, wherein the upper defines a medial slit and a lateral slit both bounding the second section and both extending downward from an upper edge of the upper partway to the sole structure.

Clause 17: The article of footwear of Clause 16, wherein: the second section has a fold region extending across the second section between a lowest extent of the medial slit and a lowest extent of the lateral slit; and the second section is thinner at the fold region than above the fold region and than below the fold region, the second section articulating at the fold region from the use position to the access position.

Clause 18: The article of footwear of any of Clauses 16-17, further comprising: a strap extending from the upper and having a distal portion releasably securable to the upper with the second section in the use position and with the strap extending across the medial slit, the second section, and the lateral slit.

Clause 19: The article of footwear of Clause 18, wherein the strap is sized to be disposed against the second section of the upper entirely below the first coupling member when the second section is in the use position and the strap is releasably secured to the upper.

Clause 20: The article of footwear of Clause 19, further comprising: a series of fasteners spaced apart from one another along an inner side of the strap; wherein an exterior surface of the second section comprises a hook-and-loop material and the series of fasteners includes hook-and-loop fasteners configured to secure to the hook-and-loop material of the second section.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. An article of footwear comprising:

a sole structure;

an upper including a first section and a second section and defining a foot-receiving cavity over the sole structure;

wherein the upper has a fold region and defines a slit extending from an edge of the upper between the first section and the second section to the fold region;

wherein the second section articulates relative to the first section at the fold region between an access position and a use position, and the foot-receiving cavity being more exposed when the second section is in the access position than when the second section is in the use position; and a magnetic coupling including a first coupling member and a second coupling member, one of which is a magnet and the other of which comprises either of a magnet or a ferromagnetic material;

wherein the first coupling member is operatively secured to the second section of the upper and the second coupling member is operatively secured to one of the upper or the sole structure and positioned so that the first coupling member couples with the second coupling member when the second section is in the access position, the first coupling member and the second coupling member being in closer proximity to one another in the access position than in the use position, and the second section held in the access position by magnetic force between the first coupling member and the second coupling member.

2. The article of footwear of claim 1, wherein the upper is thinner at the fold region than adjacent to the fold region, the upper defining a living hinge at the fold region.

3. The article of footwear of claim 1, wherein a fastener extends between the first section and the second section at the slit.

4. The article of footwear of claim 3, wherein the fastener is one of a snap, a zipper, or a button.

5. The article of footwear of claim 1, wherein an end of the slit distal from the fold region is disposed at one of a medial side or a lateral side of the upper.

6. The article of footwear of claim 1, further comprising:

a tab extending from the second section; wherein the first coupling member is disposed either on or in the tab.

7. The article of footwear of claim 6, wherein:

the tab is attached to the second section at a first location and at a second location, and the tab extends between the first location and the second location without connection to the second section, the tab at least partially forming a loop; and the first coupling member is secured at a portion of the tab between the first location and the second location.

8. The article of footwear of claim 7, wherein the tab is a flexible, non-stretch material.

9. The article of footwear of claim 7, wherein the first coupling member is covered by the tab.

10. The article of footwear of claim 9, wherein the tab is tubular and the first coupling member is disposed within the tab.

11. The article of footwear of claim 10, further comprising:

stitching extending through the tab to define a pocket in the tab; and wherein the first coupling member is disposed within the pocket.

12. The article of footwear of claim 1, wherein an upper extent of the second section extends further above the sole structure than the first section when the second section is in the use position.

13. The article of footwear of claim 1, wherein the sole structure includes a recess in an exterior surface of the sole structure and the second coupling member is at least partially disposed in the recess.

14. The article of footwear of claim 13, further comprising:

a cover extending over the second coupling member and secured to the sole structure.

15. The article of footwear of claim 1, further comprising:

a midsole having a rear wall at which the second coupling member is disposed; and an outsole having a bottom portion extending under the midsole, and having a rear portion that extends upward from the bottom portion onto the rear wall and over the second coupling member.

16. The article of footwear of claim 1, further comprising:

a strap extending from the upper and having a distal portion releasably securable to the upper with the second section in the use position and with the strap extending across the slit.

17. The article of footwear of claim 16, wherein the strap is sized to be disposed against the second section of the upper and spaced apart from the first coupling member when the second section is in the use position and the strap is releasably secured to the upper.

18. The article of footwear of claim 16, further comprising:

a series of fasteners spaced apart from one another along an inner side of the strap;

wherein an exterior surface of the second section comprises a hook-and-loop material and the series of fasteners includes hook-and-loop fasteners configured to secure to the hook-and-loop material of the second section.

19. The article of footwear of claim 1, wherein the second coupling member is disposed at or positioned on or in the sole structure.

20. The article of footwear of claim 1, wherein the upper defines another slit extending from the edge of the upper between the first section and the second section to the fold region.

* * * * *